US007115041B2

(12) United States Patent
Guard et al.

(10) Patent No.: US 7,115,041 B2
(45) **Date of Patent: *Oct. 3, 2006**

(54) PUTTER-TYPE GOLF CLUB HEAD WITH AN INSERT

(75) Inventors: John G. Guard, Oceanside, CA (US); Joshua G. Breier, Vista, CA (US); Wayne H. Byrne, Murrieta, CA (US); Augustin W. Rollinson, Carlsbad, CA (US); Ronald K. Hettinger, Oceanside, CA (US); Pijush K. Dewanjee, Carlsbad, CA (US); Herbert Reyes, Laguna Niguel, CA (US); Andrew Oldknow, Laguna Niguel, CA (US); Robert R. Lang, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 264 days.

This patent is subject to a terminal disclaimer.

(21) Appl. No.: 10/913,635

(22) Filed: Aug. 6, 2004

(65) Prior Publication Data

US 2005/0119069 A1 Jun. 2, 2005

Related U.S. Application Data

(60) Provisional application No. 60/481,733, filed on Dec. 2, 2003.

(51) Int. Cl.
*A63B 53/04* (2006.01)
*A63B 69/36* (2006.01)

(52) U.S. Cl. ..... 473/251; 473/349; 473/340; 473/342

(58) Field of Classification Search ..... 473/324–350, 473/287–291, 251–254
See application file for complete search history.

(56) References Cited

U.S. PATENT DOCUMENTS

| | | | |
|---|---|---|---|
| 626,347 | A | 6/1899 | Smith |
| 656,099 | A | 8/1900 | Dunn |
| 722,927 | A | 3/1903 | Swift |
| 807,736 | A | 12/1905 | Foulis |
| 873,423 | A | 12/1907 | Govan |
| 1,038,429 | A | 9/1912 | Penny |
| 1,211,708 | A | 1/1917 | Hudson |
| 1,257,471 | A | 2/1918 | Stanton |
| 1,299,014 | A | 4/1919 | O'Hara |
| 1,412,650 | A | 4/1922 | Booth |
| 1,413,854 | A | 4/1922 | Khaeuter |
| 1,423,341 | A | 7/1922 | Lippincott |
| 1,435,319 | A | 11/1922 | Mattern |
| 1,437,463 | A | 12/1922 | Boye |
| 1,449,559 | A | 3/1923 | Relle |

(Continued)

*Primary Examiner*—Sebastiano Passaniti
(74) *Attorney, Agent, or Firm*—Michael A. Catania; Elaine H. Lo

(57) ABSTRACT

A method for manufacturing a golf club head with an insert having a face plate is disclosed herein. The insert is disposed in a recess of the club head in which the recess has a depth that is greater than the thickness of the insert. The insert is preferably composed of a thermoplastic polyurethane material formed from a polytetramethylene ether glycol terminated hexamethylene diisocyanate prepolymer having a NCO group content of 8.0% to 12.0%, and a 1,4 butane diol. An adhesive is preferably disposed between the rear wall of the recess and an interior surface of the insert. Further, an adhesive is applied between the plurality of tabs, and preferably over the exterior surface of each of the plurality of tabs.

42 Claims, 17 Drawing Sheets

U.S. PATENT DOCUMENTS

| | | | |
|---|---|---|---|
| 1,463,533 | A | 7/1923 | Kurz, Jr. |
| 1,467,714 | A | 9/1923 | Doerr |
| 1,485,685 | A | 3/1924 | McMahon |
| 1,494,494 | A | 5/1924 | Lippincott |
| 1,509,429 | A | 9/1924 | Hillerich |
| 1,511,479 | A | 10/1924 | Kelly et al. |
| 1,524,731 | A | 2/1925 | Davis |
| 1,525,137 | A | 2/1925 | Lawton |
| 1,525,352 | A | 2/1925 | Aitken |
| 1,540,550 | A | 6/1925 | East |
| 1,543,691 | A | 6/1925 | Beat |
| 1,546,612 | A | 7/1925 | Barnes |
| 1,558,703 | A | 10/1925 | Miller |
| 1,567,248 | A | 12/1925 | Dahlman |
| 1,592,463 | A | 7/1926 | Marker |
| 1,595,589 | A | 8/1926 | Tyler |
| 1,611,110 | A | 12/1926 | East |
| 1,615,038 | A | 1/1927 | Reuter, Jr. |
| 1,646,461 | A | 10/1927 | So Relle |
| 1,647,487 | A | 11/1927 | Vernon |
| 1,654,257 | A | 12/1927 | Hillerich |
| 1,659,272 | A | 2/1928 | Link |
| 1,673,994 | A | 6/1928 | Quynn |
| 1,674,173 | A | 6/1928 | Haupt |
| 1,675,437 | A | 7/1928 | Waldron |
| 1,678,637 | A | 7/1928 | Drevitson |
| 1,699,874 | A | 1/1929 | Buhrke |
| 1,704,119 | A | 3/1929 | Buhrke |
| 1,704,165 | A | 3/1929 | Buhrke |
| 1,720,867 | A | 7/1929 | Webster et al. |
| 1,840,451 | A | 1/1932 | Jansky |
| 1,847,963 | A | 3/1932 | Hix |
| 1,901,562 | A | 3/1933 | Main |
| 1,907,134 | A | 5/1933 | Weiskopf |
| 1,930,477 | A | 10/1933 | Hosier |
| 1,968,092 | A | 7/1934 | Oldham |
| 1,968,627 | A | 7/1934 | Young |
| 2,023,885 | A | 12/1935 | Hinckley |
| 2,144,846 | A | 1/1939 | Krupse |
| 2,346,617 | A | 4/1944 | Schaffer |
| 2,395,837 | A | 3/1946 | Baymiller et al. |
| 2,414,234 | A | 1/1947 | Link |
| 2,460,435 | A | 2/1949 | Schaffer |
| 2,472,312 | A | 6/1949 | Parrish |
| 2,472,978 | A | 6/1949 | Mahon |
| 2,665,909 | A | 1/1954 | Wilson |
| 2,686,056 | A | 8/1954 | Oquist |
| 2,766,047 | A | 10/1956 | Karns |
| 2,826,417 | A | 3/1958 | Marcoccio |
| 2,968,486 | A | 1/1961 | Walton |
| 3,172,667 | A | 3/1965 | Baker et al. |
| 3,218,072 | A | 11/1965 | Burr |
| 3,232,619 | A | 2/1966 | Burk |
| 3,233,905 | A | 2/1966 | Flom |
| 3,341,202 | A | 9/1967 | Stars |
| 3,368,812 | A | 2/1968 | Baldwin |
| D211,800 | S | 7/1968 | Hunter |
| 3,390,881 | A | 7/1968 | Senne |
| 3,394,937 | A | 7/1968 | Allport |
| 3,430,963 | A | 3/1969 | Wozniak et al. |
| D216,030 | S | 11/1969 | Wigley |
| 3,489,412 | A | 1/1970 | Franck et al. |
| 3,547,445 | A | 12/1970 | Hardesty |
| 3,567,228 | A | 3/1971 | Lynn |
| 3,571,900 | A | 3/1971 | Hardesty |
| 3,625,518 | A | 12/1971 | Solheim |
| 3,637,218 | A | 1/1972 | Carlino |
| 3,640,324 | A | 2/1972 | Porter |
| 3,659,855 | A | 5/1972 | Hardesty |
| 3,695,618 | A | 10/1972 | Woolley et al. |
| 3,720,410 | A | 3/1973 | Saytar |
| 3,759,527 | A | 9/1973 | Witherspoon |
| 3,819,180 | A | 6/1974 | Murphy |
| 3,834,700 | A | 9/1974 | Averbach |
| 3,836,153 | A | 9/1974 | Dance, Jr. |
| 3,881,733 | A | 5/1975 | Csernits |
| 3,897,066 | A | 7/1975 | Belmont |
| 3,908,996 | A | 9/1975 | Molinaro |
| 3,909,005 | A | 9/1975 | Piszel |
| 4,162,794 | A | 7/1979 | Thompson |
| 4,181,306 | A | 1/1980 | Jepson |
| 4,252,262 | A | 2/1981 | Igarashi |
| D262,049 | S | 11/1981 | Simmons |
| 4,569,524 | A | 2/1986 | Quijano C. |
| 4,681,322 | A | 7/1987 | Straza et al. |
| 4,688,798 | A | 8/1987 | Pelz |
| 4,749,197 | A | 6/1988 | Orlowski |
| 4,801,146 | A | 1/1989 | Honma |
| 4,812,187 | A | 3/1989 | Honma |
| 4,884,808 | A | 12/1989 | Retzer |
| 4,934,703 | A | 6/1990 | Delaney |
| 5,141,231 | A | 8/1992 | Cox |
| 5,221,087 | A | 6/1993 | Fenton et al. |
| 5,226,654 | A | 7/1993 | Solheim |
| 5,292,128 | A | 3/1994 | Solheim |
| 5,332,223 | A | 7/1994 | Johnson |
| 5,362,055 | A | 11/1994 | Rennie |
| 5,411,263 | A | 5/1995 | Schmidt et al. |
| 5,417,419 | A | 5/1995 | Anderson et al. |
| 5,431,396 | A | 7/1995 | Shieh |
| 5,445,386 | A | 8/1995 | Marshall |
| 5,458,332 | A | 10/1995 | Fisher |
| 5,460,377 | A | 10/1995 | Schmidt et al. |
| 5,464,218 | A | 11/1995 | Schmidt et al. |
| 5,472,201 | A | 12/1995 | Aizawa et al. |
| 5,482,281 | A | 1/1996 | Anderson |
| 5,485,997 | A | 1/1996 | Schmidt et al. |
| 5,489,094 | A | 2/1996 | Pritchett |
| 5,489,098 | A | 2/1996 | Gojny et al. |
| 5,497,993 | A | 3/1996 | Shan |
| 5,505,453 | A | 4/1996 | Mack |
| 5,524,331 | A | 6/1996 | Pond |
| 5,536,006 | A | 7/1996 | Shieh |
| 5,542,675 | A | 8/1996 | Micciche et al. |
| 5,544,879 | A | 8/1996 | Collins |
| 5,580,322 | A | 12/1996 | Bouquet |
| 5,586,948 | A | 12/1996 | Mick |
| 5,674,132 | A | 10/1997 | Fisher |
| 5,785,608 | A | 7/1998 | Collins |
| 5,803,824 | A | 9/1998 | Rollingson |
| 5,842,935 | A | 12/1998 | Nelson |
| 5,921,871 | A | 7/1999 | Fisher |
| 6,074,309 | A | 6/2000 | Mahaffey |
| 6,093,116 | A | 7/2000 | Hettinger et al. |
| 6,095,931 | A | 8/2000 | Hettinger et al. |
| 6,203,446 | B1 | 3/2001 | Collins |
| 6,227,986 | B1 | 5/2001 | Fisher |
| 6,231,458 | B1 | 5/2001 | Cameron et al. |
| 6,238,302 | B1 | 5/2001 | Helmstetter et al. |
| 6,273,831 | B1 | 8/2001 | Dewanjee |
| 6,302,807 | B1 | 10/2001 | Rohrer |
| 6,328,661 | B1 | 12/2001 | Helmstetter et al. |
| 6,336,869 | B1 | 1/2002 | Hettinger et al. |
| 6,354,959 | B1 | 3/2002 | Nicolette et al. |
| 6,375,583 | B1 | 4/2002 | Solheim |
| 6,386,991 | B1 | 5/2002 | Reyes et al. |
| 6,422,949 | B1 | 7/2002 | Byrne et al. |
| 6,441,098 | B1 | 8/2002 | Halko et al. |
| 6,471,600 | B1 | 10/2002 | Tang et al. |
| 6,478,694 | B1 | 11/2002 | Anderson et al. |
| 6,506,125 | B1 | 1/2003 | Helmstetter et al. |
| 6,623,372 | B1 | 9/2003 | Beebe et al. |
| 6,659,883 | B1 | 12/2003 | Nelson et al. |
| 6,663,496 | B1 | 12/2003 | Cameron et al. |

6,663,497 B1 12/2003 Cameron
6,663,502 B1 12/2003 Nelson et al.
6,743,112 B1 6/2004 Nelson
6,837,799 B1 1/2005 Cameron et al.
6,837,801 B1 1/2005 Souza et al.
6,878,074 B1 4/2005 Byrne et al.
6,893,355 B1 5/2005 Souza et al.
6,893,358 B1 5/2005 Dewanjee et al.
6,902,496 B1 6/2005 Solheim et al.
6,926,615 B1 8/2005 Souza et al.
6,932,716 B1 8/2005 Ehlers et al.
6,960,140 B1 11/2005 Solheim et al.
6,966,845 B1 11/2005 Solheim et al.
6,971,960 B1 * 12/2005 Dewanjee et al. ..... 473/340
7,048,648 B1 * 5/2006 Breier et al. ..... 473/340

* cited by examiner

FIG. 3
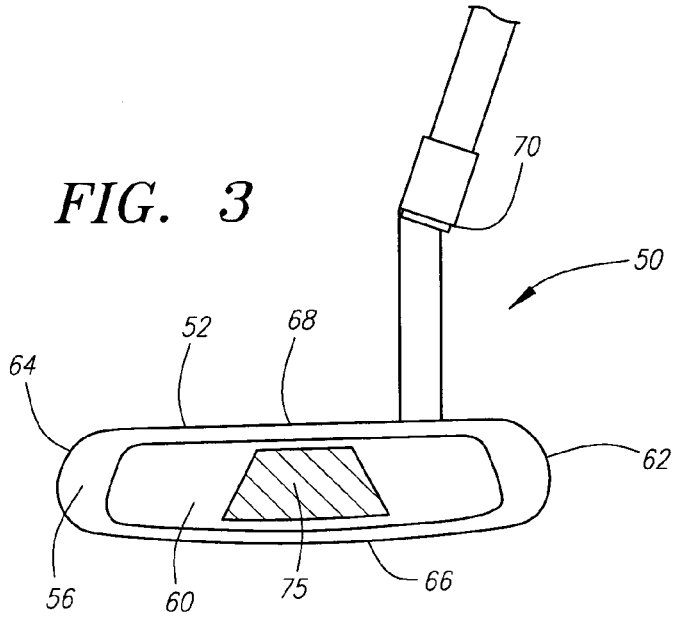
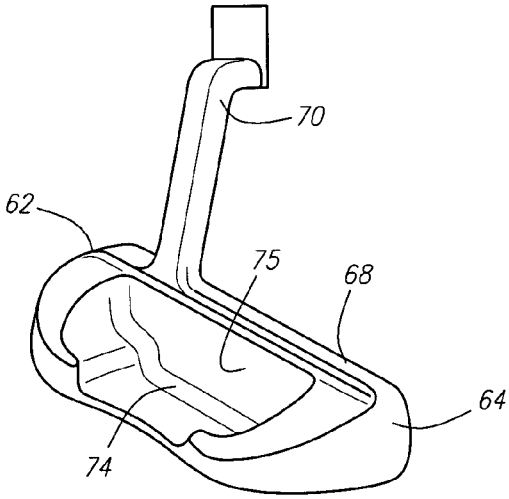
FIG. 3A
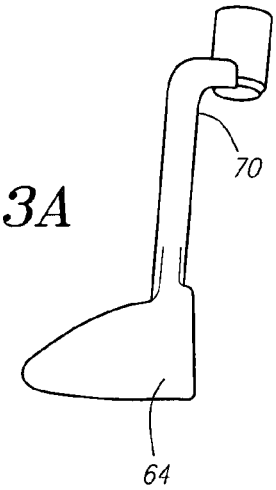
FIG. 3B
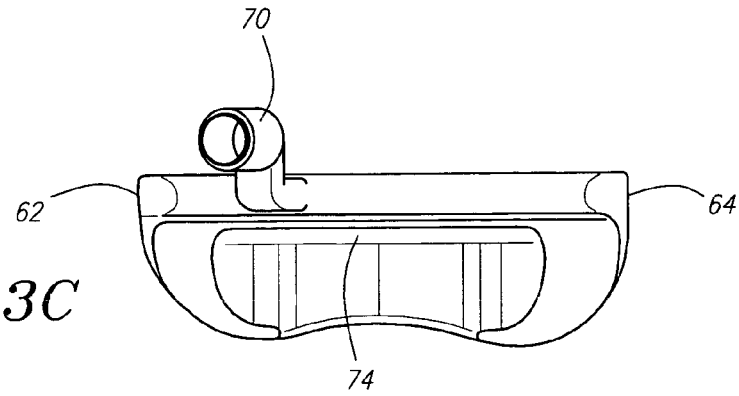
FIG. 3C

FIG. 5
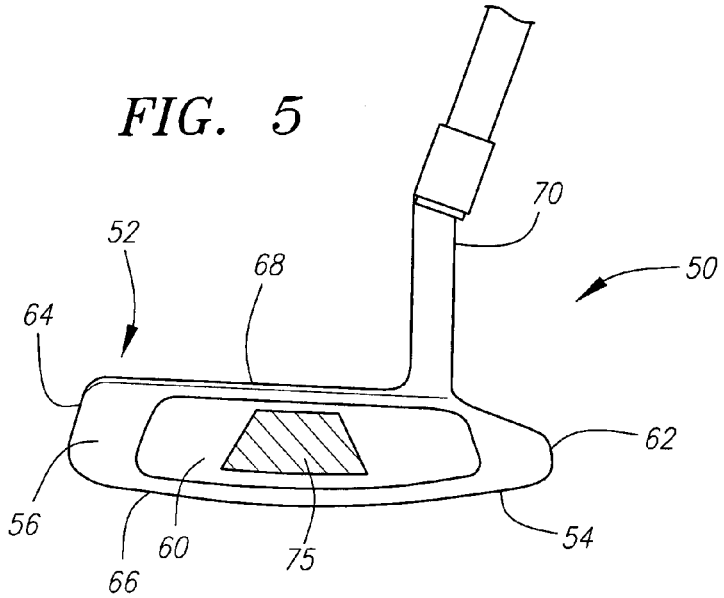
FIG. 5B
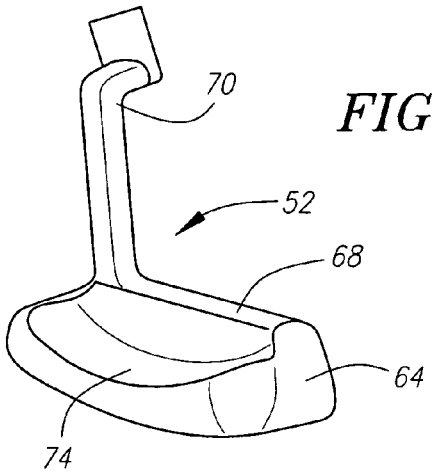
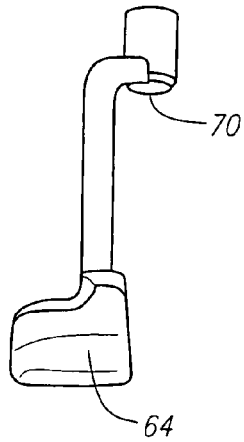
FIG. 5A
FIG. 5C
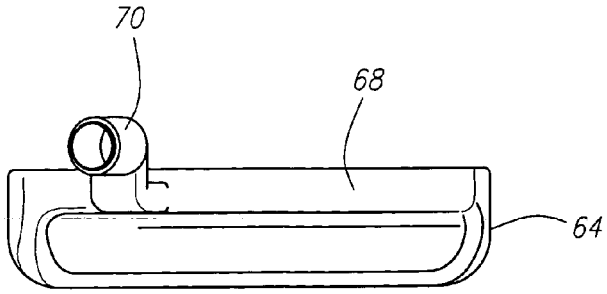

PUTTER-TYPE GOLF CLUB HEAD WITH AN INSERT

CROSS REFERENCES TO RELATED APPLICATIONS

The Present Application is a continuation-in-part application U.S. Provisional Patent Application No. 60/481,733, filed on Dec. 2, 2003.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with an insert. More specifically, the present invention relates to a putter head with a polymer insert having a face plate.

2. Description of the Related Art

Throughout the history of golf, which dates back to as early as 1457, various techniques have been used to enhance the hitting characteristics of golf club heads. Golf club heads having inserts for the striking portion have been used at least as far back as 1880's when leather face irons were manufactured in Scotland. Golfer's in the 1890's were able to purchase putters with faces composed of gutta percha. More recently, inserts composed of various materials and shapes have been put forth by the creative geniuses of the golf industry to provide golfers with better feel and control of the golf ball.

One example is an ODYSSEY® DUAL FORCE® putter having a STRONOMIC® insert that is disclosed in Magerman et al., U.S. Pat. No. 5,575,472 for a Golf Putter Head Having Face Insert And Method Of Forming The Same. The Magerman, et al. Patent discloses a putter head with a recess into which is poured or inserted a resinous material which cures and is subsequently milled to produce the putter.

Another example is an ODYSSEY® WHITE HOT® putter having an insert composed of a polyurethane material. The ODYSSEY® WHITE HOT® putter is disclosed in U.S. Pat. No. 6,238,302 for a Golf Club Head With An Insert Having Integral Tabs.

Another example is Pond, U.S. Pat. No. 5,524,331 for a Method For Manufacturing Golf Club Head With Integral Inserts that discloses a method for casting a graphite-epoxy composite insert within a recess of a face of a metal club head. The golf club head of the Pond Patent is directed at displacing the weight away from the center and increasing the moment of inertia.

Another example is Schmidt et al., U.S. Pat. No. 5,485,997, for a Golf Putter Head With Face Plate Insert Having Heightened Medial Portion, that discloses a putter head with a face plate composed of a non-metallic material such as an elastomer. The overall construction of the putter head of the Schmidt et al. Patent is directed at enlarging the sweet spot and improving the peripheral weighting.

Yet another example is found in Baker et al., U.S. Pat. No. 5,931,743 for a Putter Having Club Head With A Golf-Ball Engagement Insert And A Shaft Rearwardly Of The Insert which discloses a putter with a center shaft and an insert composed of a thermoplastic polyurethane. Another example is Jepson et al., U.S. Pat. No. 3,937,474 for a Golf Club With Polyurethane Insert, which discloses a wood having an insert on its striking face that is composed of a polyurethane formed from a tolylene diisocyanate polyether terminated prepolymer and a curing agent. The hardness of this insert varies from 40 to 75 shore D, and a Bashore Resiliometer of 17 or above. The polyurethane insert is claimed to impart additional energy to the golf ball during a golf hit.

Chen et al., U.S. Pat. No. 5,743,813 for a Golf Club Head discloses a wood composed of stainless steel with a three layer face having a first stainless steel layer, an elastic layer and a second stainless steel layer. The three-layer face does not absorb the hitting force when a golf ball is hit.

Fisher, U.S. Pat. No. 5,458,332, for a Golf Putter Head With A Cushioning Face, discloses a set of golf putters, each having an insert composed of polyurethane with a hardness in the range of 70 Shore A to about 80 Shore D. The rebound factor of each of the inserts is in the range of 12.5% to 50%, and the inserts are formulated to effect a reproducible direct linear relationship between the rebound factor and the distance of the putt.

Yet another example is McGeeney et al, European Patent Application Number 0891790 for a Multiple Density Golf Club Head And Method Of Manufacturing which discloses a putter with a central segment composed of a thermoplastic elastomer or a thermoset polymer. Possible thermoplastic elastomers include styrene co-polymers, co-polyesters, polyurethanes, polyamides, olefins and vulcanates. Possible thermoset polymers include epoxides, polyimides and polyester resins. The central segment has a minimum durometer hardness of Shore D 50. The central segment is bounded by metallic heel and to portions. However, the use of inserts is restrained in order to maintain the integrity of the game of golf.

In this regard, the Rules of Golf, established and interpreted by the United States Golf Association ("USGA") and The Royal and Ancient Golf Club of Saint Andrews, sets forth certain requirements for a golf club head. The requirements for a golf club head are found in Rule 4 and appendix II. A complete description of the Rules of Golf are available on the USGA web page at www.usga.org. Although the Rules of Golf do not expressly state specific parameters for an insert for a putter, the Rules of Golf have been interpreted to establish that an insert for a putter should have a Shore A hardness greater than 87±2%, have a constant thickness, have a thickness of at least 0.125 inches, and not act like a spring.

Issues with the inserts of the prior art include complex processing, yellowing of polyurethane materials, and deformation under extended high temperatures.

BRIEF SUMMARY OF THE INVENTION

The present invention provides an insert for a golf club head that is easy to manufacture, non-yellowing, and has outstanding heat deflection. The present invention is able to accomplish this by providing an insert composed of a thermoplastic polyurethane material formed from a polytetramethylene ether glycol terminated hexamethylene diisocyanate prepolymer and a 1,4 butane diol.

One aspect of the present invention is a golf club head including a club head body with an insert and a face plate. The club head body has a front face with a recess therein. The insert is disposed within the recess. The insert includes a body with an exterior surface, an interior surface and a perimeter defining the thickness of the body. The insert is composed of a thermoplastic polyurethane material formed from a polytetramethylene ether glycol terminated hexamethylene diisocyanate prepolymer and a 1,4 butane diol, wherein the insert has a Shore D hardness ranging from 50 to 65. The perimeter preferably has a plurality of integral tabs extending therefrom that engage the club head body.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is a front view of another embodiment of the golf club head of the present invention with an insert in the recess of the club head body.

FIG. 3A is a side view of the club head of FIG. 3.

FIG. 3B is a rear view of the club head of FIG. 3.

FIG. 3C is a top view of the club head of FIG. 3.

FIG. 5 is a front view of another embodiment of the golf club head of the present invention with an insert in the recess of the club head body.

FIG. 5A is a side view of the club head of FIG. 5.

FIG. 5B is a rear view of the club head of FIG. 5.

FIG. 5C is a top view of the club head of FIG. S.

DETAILED DESCRIPTION OF THE INVENTION

Figure 1:
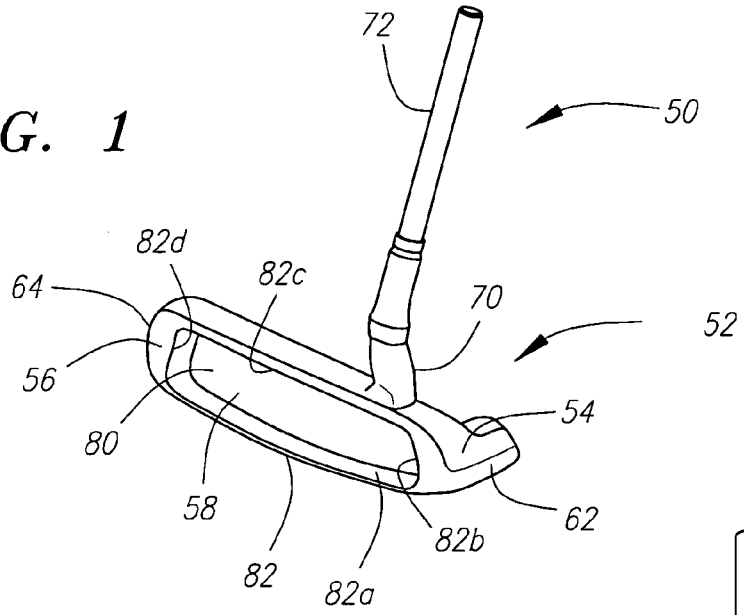
FIG. 1 is a perspective view of one embodiment of the golf club head of the present invention without an insert in the recess of the club head body.
Figure 1B:
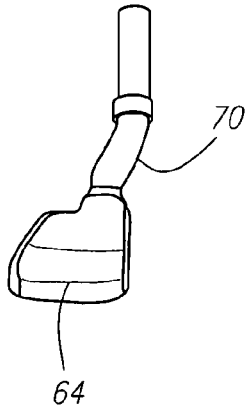
FIG. 1B is a side view of the club head of FIG. 1.
Figure 1A:
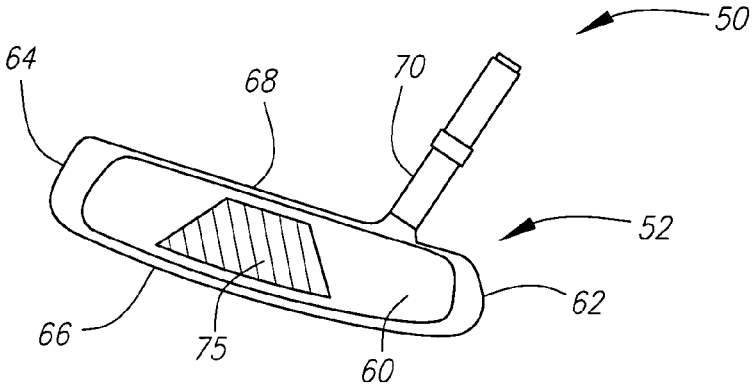
FIG. 1A is a front view of the club head of FIG. 1 with the insert placed therein.
Figure 1C:
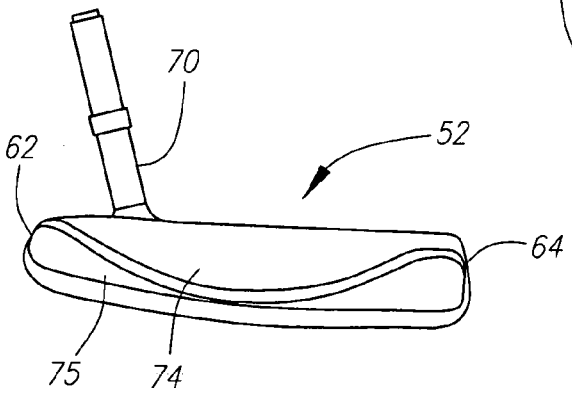
FIG. 1C is a rear view of the club head of FIG. 1.
Figure 1D:
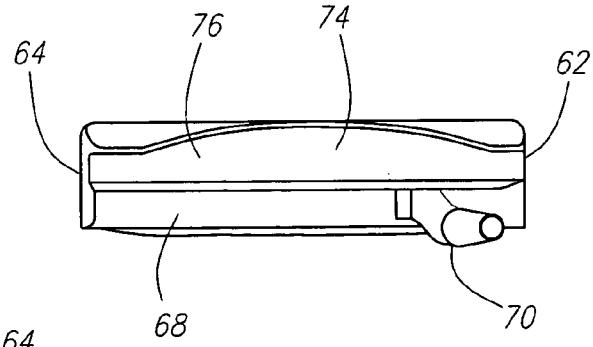
FIG. 1D is a top view of the club head of FIG. 1.

As shown in FIGS. 1 through 1D, a putter of the present invention is generally designated 50. The putter 50 includes a club head 52 having a body 54 with a front face 56 with a recess 58 therein. The club head 52 of the present invention also includes an insert 60 disposed within the recess 56. The insert 60 extends along most of the face 56 from a heel 62 of the club head 52 to a toe 64 of the club head 52, and from a sole 66 of the club head 52 to a crown 68 of the club head 52. The insert 60 has an indentation 65. A face plate 75 is disposed within the indentation 65. The club head 52 also has a hosel 70 for connection to a shaft 72. Opposite of the front face 56 of the club head 52 is a rear 74 of the club head 52.

The body 54 of the club head 52 is preferably composed of a metallic material such as stainless steel. Other metallic materials include titanium, aluminum, tungsten, zinc, magnesium, and alloys of stainless steel and tungsten. However, those skilled in the pertinent art will recognize that the body 54 may be composed of other materials without departing from the scope and spirit of the present invention. Further, the non-insert portion of the face 56 may be smooth or textured to provide a consistent or non-consistent surface with the exterior surface of the insert. Additionally, the body 54 may be specifically weighted to provide a specific center of gravity and inertial properties for the putter 50.

FIGS. 2–6C illustrate various embodiments of putters 50 of the present invention. Each of the putters 50 of FIGS. 2–6C has a club head 52 with a body 54, an insert 60 disposed within a recess 58 of the body 54, and a face plate 75 disposed within the indentation 65. The putters 50 illustrated in FIGS. 1–6C are flanged blade, mallet and semi-mallet putters, however, those skilled in the art will recognize that other similar putter designs may be utilized without departing from the scope and spirit of the present invention. In a preferred embodiment, each of the club heads 52 weigh approximately 328 grams ±7 grams. Further, in a preferred embodiment, the recess 58 of each of the club heads 52 has a depth of approximately 0.205 inches ±0.010 inches.

Referring specifically to FIG. 1, the recess 58 of the body 54 is defined by a recess face wall 80 which is substantially parallel with the insert 60, and a recess edge wall 82 which is substantially perpendicular to the recess face wall 80. The recess face wall 80 defines the depth of the recess 58 that will determine the thickness of the polymer insert 60. The recess edge wall 82, as shown in FIG. 1, is composed of a bottom recess edge wall 82*a*, a heel recess edge wall 82*b*, a top recess edge wall 82*c* and a toe recess edge wall 82*d*. The recess edge wall 82 defines the shape of the recess 58, and the length of the recess edge wall 82 is determined by the depth of the recess 58. In a preferred embodiment, the insert 60 will engage the recess edge wall 82 as described below.

The putter 50 of FIGS. 1–1D is a flanged blade style putter. The rear 74 of the club head 52 has a rear wall 75 and a flanged portion 77. The insert 60 of this embodiment occupies approximately 67.90% of the face area of the club head 52. The insert 60 also occupies approximately 20.71% of the volume of the club head 52. Yet further, the insert 60 of this embodiment is approximately 3.95% of the weight of the club head 52.

Figure 2:
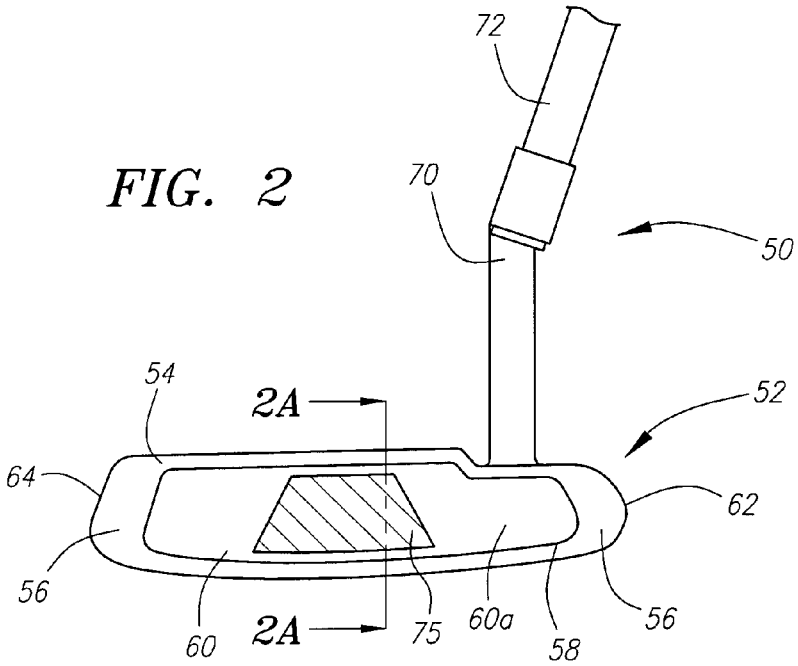
FIG. 2 is a front view of another embodiment of the golf club head of the present invention with an insert in the recess of the club head body.
Figure 2B:
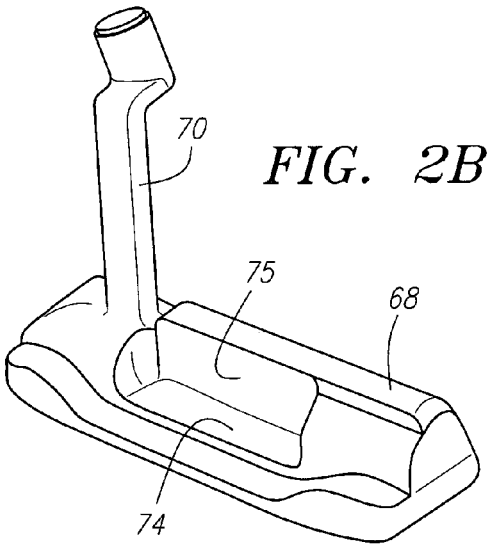
FIG. 2B is a rear view of the club head of FIG. 2.
Figure 2A:
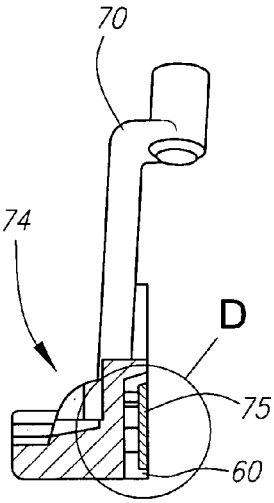
FIG. 2A is a partial cross-sectional side view of the club head of FIG. 2.
Figure 2C:
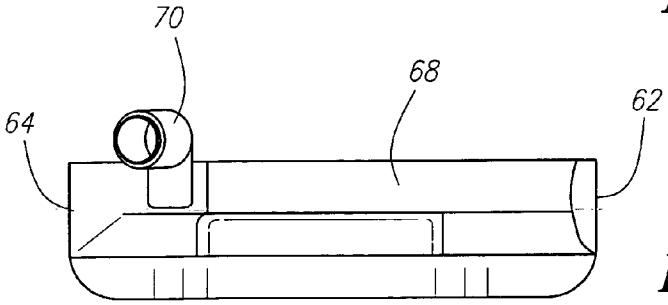
FIG. 2C is a top view of the club head of FIG. 2.
Figure 2D:
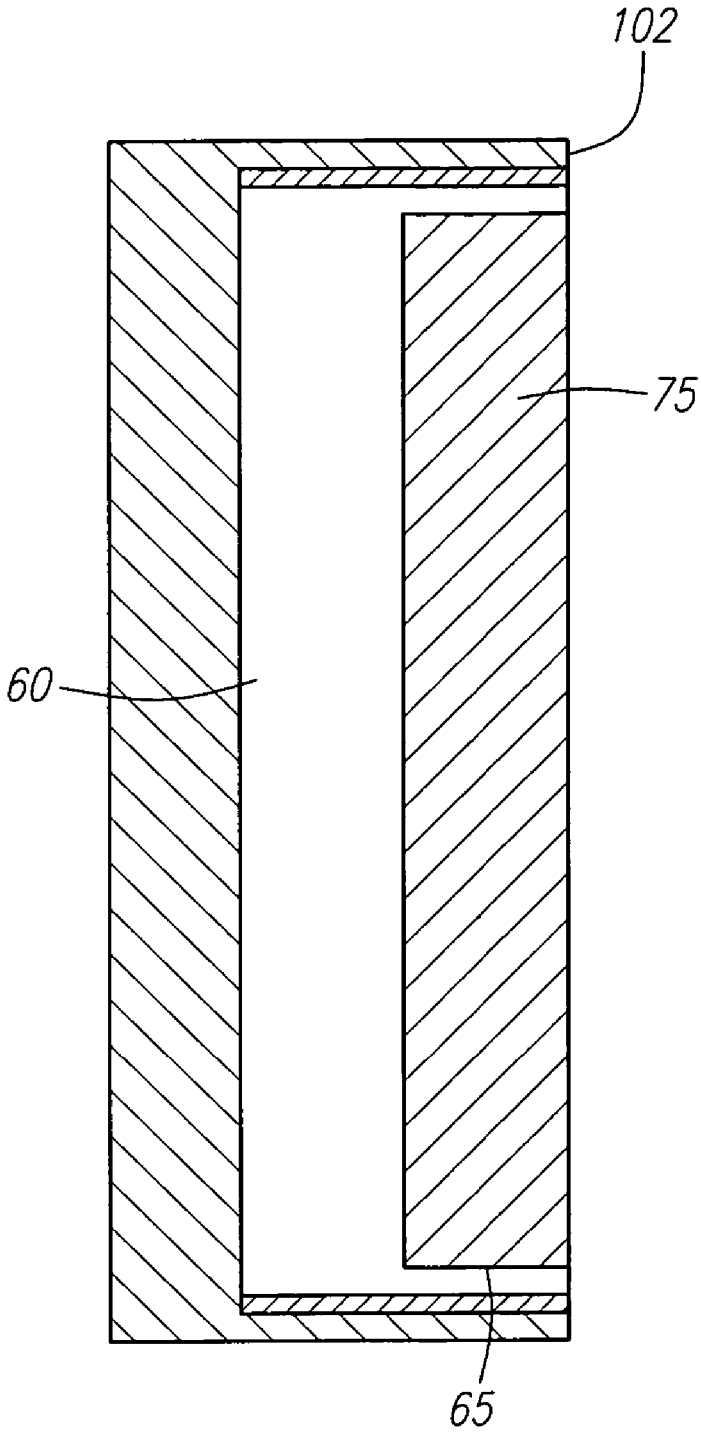
FIG. 2D is an enlarged view of circle D of FIG. 2A.

The putter 50 of FIGS. 2–2C is also a blade style putter, however, it has an offset hosel 70, and an insert 60 with a panhandle portion 60*a*. The insert 60 is one-piece, including the panhandle portion 60*a*. It is apparent from FIG. 2 that this putter 50 has a larger area of the non-insert portion of the face 56 than the embodiment shown in FIG. 1A. The insert 60 of this embodiment occupies approximately 69.22% of the face area of the club head 52. The insert 60 also occupies approximately 20.33% of the volume of the club head 52. Yet further, the insert 60 of this embodiment is approximately 3.86% of the weight of the club head 52. FIG. 2D illustrates a enlarged view of a cross-section of the putter 50 with the face plate 75 within the indentation 65 of the insert 60 which is within the recess 58 of the face 56 club head 52.

The putter 50 of FIGS. 3–3C is a half-mallet style putter with an offset hosel 70. The insert 60 has a trapezoidal shape with parallel sides and a curved bottom portion. It is apparent from FIG. 3 that the toe end and heel end of the face 56 of this putter 50 has a large area of the non-insert portion. The insert 60 of this embodiment occupies approximately 68.27% of the face area of the club head 52. The insert 60 also occupies approximately 17.15% of the volume of the club head 52. Yet further, the insert 60 of this embodiment is approximately 3.08% of the weight of the club head 52.

Figure 4:
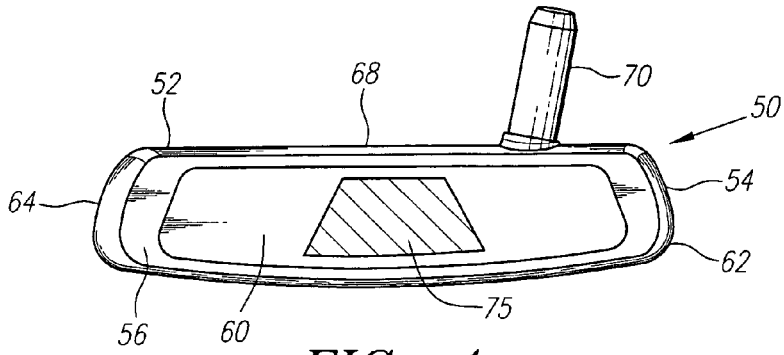
FIG. 4 is a front view of another embodiment of the golf club head of the present invention with an insert in the recess of the club head body.
Figure 4A:
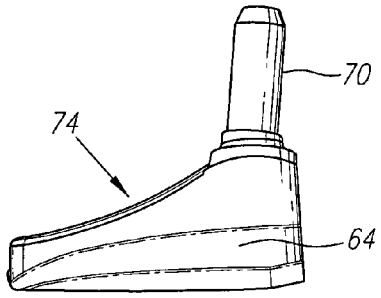
FIG. 4A is a side view of the club head of FIG. 4.
Figure 4B:
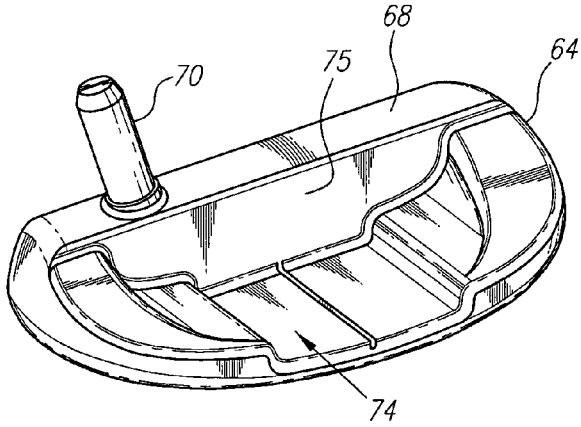
FIG. 4B is a rear view of the club head of FIG. 4.
Figure 4C:
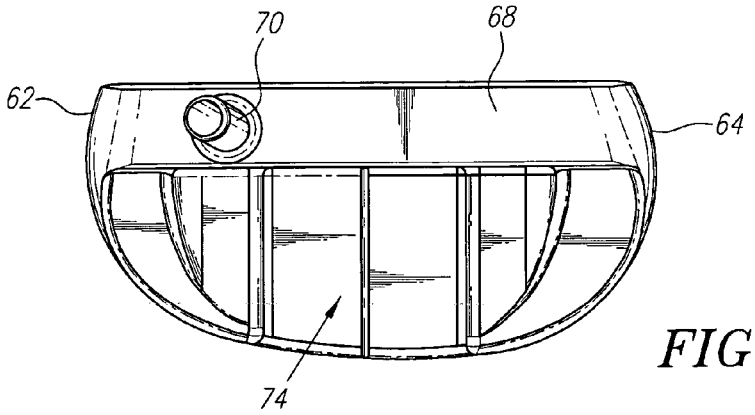
FIG. 4C is a top view of the club head of FIG. 4.

The putter of FIGS. 4–4C is a mallet style putter, however, it does not have an offset hosel 70. The insert 60 of this embodiment occupies the largest amount of the face area of the club head 52, approximately 70.38%. However, the insert 60 occupies the smallest volume of the club head 52, approximately 16.24%. Yet further, the insert 60 of this embodiment is the lightest, weighing approximately 2.46% of the club head 52.

Figure 6:
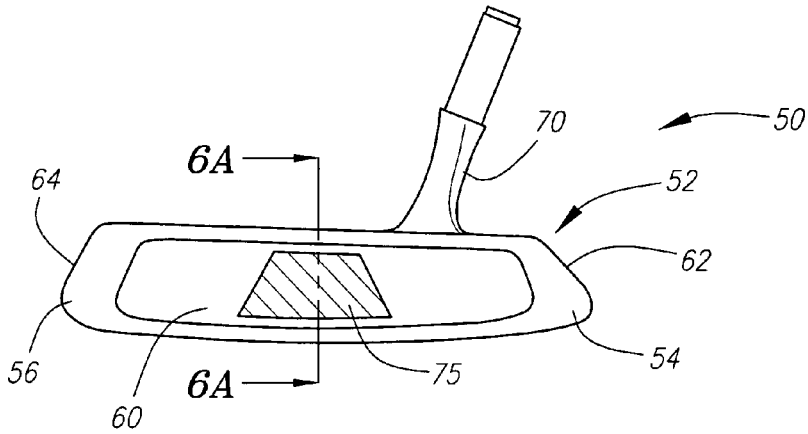
FIG. 6 is a front view of another embodiment of the golf club head of the present invention with an insert in the recess of the club head body.
Figure 6B:
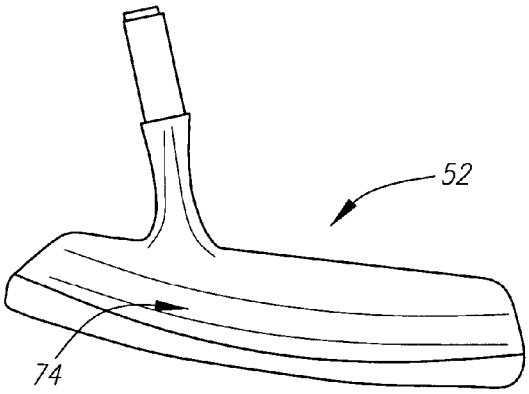
FIG. 6B is a rear view of the club head of FIG. 6.
Figure 6A:
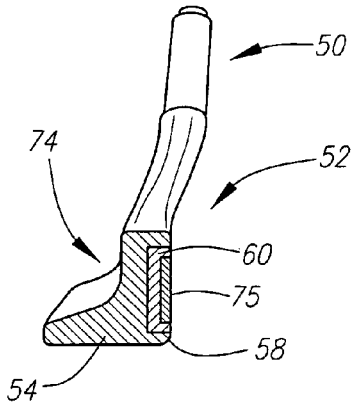
FIG. 6A is a partial cross-sectional side view of the club head of FIG. 6.
Figure 6C:
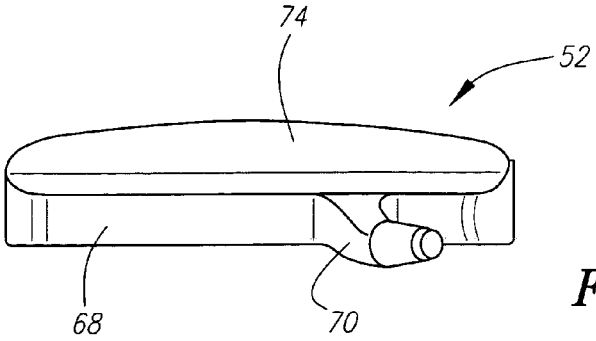
FIG. 6C is a top view of the club head of FIG. 6.

The putter 50 of FIGS. 5–5C is a flanged-blade style putter with an offset hosel 70. The insert 60 has a trapezoidal shape with parallel sides and a curved bottom portion. It is apparent from FIG. 5 that the toe end and heel end of the face 56 of this putter 50 has a non-insert portion larger than any of the other embodiments. The insert 60 of this embodiment only occupies approximately 59.82% of the face area of the club head 52. The insert 60 also occupies approximately 18.43% of the volume of the club head 52. Yet further, the insert 60 of this embodiment is approximately 3.42% of the weight of the club head 52. The putter of FIGS. 6–6C is a blade style putter. As shown in FIG. 6A, the polymer 60 only occupies a small portion of the volume of the club head 52 compared to the body 54 of the club head 52.

The inserts 60 of FIGS. 1–6C vary in shape and thickness depending on the design of the putter 50. A preferred shape of the insert 60 is a trapezoidal shape with curved corners. An alternative shape is a trapezoidal shape with a panhandle as illustrated in FIG. 2. The weight of the insert 60 may be adjusted, and may vary in a range of 1.0%–5% of the weight of the club head 52. Further, the volume of the insert 60 may vary between 10% and 25% of the volume of the club head 52. Additionally, the percentage of the face area occupied by the insert 60 may vary between 55% and 75% of the total area of the face 56.

In a preferred embodiment, the insert 60 is composed of a thermoplastic polyurethane material, preferably an injection moldable thermoplastic polyurethane. The preferred polyurethane prepolymers are polytetramethylene ether glycol terminated hexamethylene diisocyanate prepolymers available from Uniroyal Chemical under the tradename ADIPRENE® LFH750, ADIPRENE® LFH749 and ADIPRENE® LFH720, which are aliphatic polyurethane prepolymers. The NCO group content of the polytetramethylene ether glycol terminated hexamethylene diisocyanate prepolymer is preferably in the range of 8.0% to 12.0%, more preferably in the range of 10.0% to 11.5%, and most preferably 11%. Alternative prepolymers include polypropylene glycol terminated hexamethylene diisocyanate prepolymer, polycaprolactone terminated hexamethylene diisocyanate prepolymer, and polyester terminated hexamethylene diisocyanate prepolymer.

The prepolymer is preferably cured with a 1,4 butane diol. However, alternative curatives include ethylene glycols, diethylene Glycols, polyethylene glycols, polypropylene glycols, propylene glycols, lower molecular weight polytetramethylene ether glycol glycols, 1,3 bis(2-hydoxyethoxy) benzene, 1,3 bis((2-(2-hydroxyethoxy)ethoxy))benzene, 1,3 bis(((2-((2-(2-hydroxyethoxy)ethoxy)))benzene, 1,5 pentane diol, 1,6 hexane diol, resorcinol-di-(Beta-hydroxyethyl) ether, hydroquinone-di-(Beta-hydroxyethyl)ether, trimethylol Propane (TMP), and the mixtures thereof.

A colorant material, such as, for example, titanium dioxide, barium sulfate, and/or zinc oxide in a glycol or castor oil carrier, and/or other additive material(s) as are well known in the art, may be added to polyurethane precursor mixture. The amount of colorant material added is preferably in the range of about 0–10% by weight of the combined polyurethane prepolymer and curative materials, and more preferably in the range of about 2–8%.

Plasticizers such as Benzoflex and Pthalate type plasticizers (e.g., di octyl pthalate), may be added to the insert mixture to soften or lower the hardness of the final thermoplastic polyurethane material for better feel.

The Shore D hardness of the thermoplastic polyurethane material for the insert 60 preferably ranges from 40 to 70 Shore D, more preferably from 50 to 65 Shore D, and is most preferably approximately 60 Shore D.

The thickness of the insert 60 may vary depending on its application. A preferred thickness for a putter 50 is in the range of 0.125 to 0.500 inch. A preferred range of thickness is 0.188 inch to 0.200 inch. A preferred thickness is 0.198 inch. The thickness of the insert 60 is increased or decreased to influence the feel to the golfer during impact with a golf ball.

The indentation 65 of the insert 60 preferably has a depth of ranging from 0.020 inch to 0.075 inch, more preferably ranging from 0.035 inch to 0.045 inch, and most preferably having a depth of 0.040 inch. The indentation 65 is sized to accommodate the face plate 75.

Figure 7:
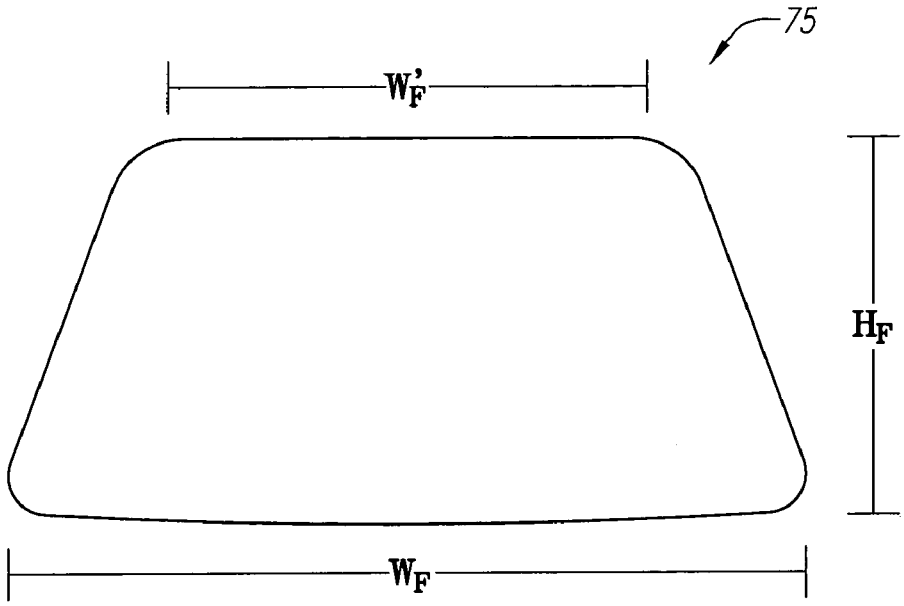
FIG. 7 is an isolated front view of a face plate.
Figure 8:
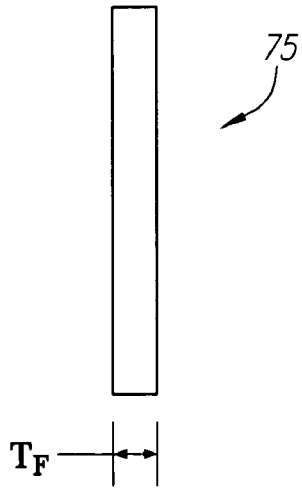
FIG. 8 is an isolated side view of a face plate.

The face plate 75 is preferably composed of a metal material. Such metal materials include stainless steel, steel, other steel alloys, titanium, titanium alloys, amorphous metals, aluminum, aluminum alloys, magnesium, magnesium alloys, bronze, and other like metal materials. As shown in FIG. 8, the face plate 75 preferably has a thickness ranging from 0.020 inch to 0.075 inch, and more preferably ranging from 0.035 inch to 0.045 inch, and most preferably having a thickness of 0.040 inch. As shown in FIG. 7, the face plate 75 preferably has a height, Hf, that ranges from 0.30 inch to 0.80 inch, more preferably from 0.50 inch to 0.70 inch, and most preferably 0.60 inch. The face plate 75 preferably has a trapezoidal shape with a bottom width, Wf, ranging from 1.0 inch to 2.0 inches, more preferably from 1.20 inches to 1.75 inches, and most preferably 1.27 inches. The top width, W'f, of the face plate 75 preferably has a length ranging from 0.50 inch to 1.5 inches, more preferably from 0.70 inch to 1.25 inches, and most preferably 0.88 inch.

The face plate 75 preferably is positioned at the center of the face of the putter 20. The face plate 75 preferably covers less than 90% of the exterior surface of the insert 60, and more preferably less than 60% of the exterior surface of the insert, and most preferably covers between 25% to 50% of the exterior surface of the insert 60.

The face plate 75 is preferably co-molded with the insert 60. Alternatively, the face plate 75 is bonded within the indentation 65 of the insert 60 with an adhesive.

Figure 9:
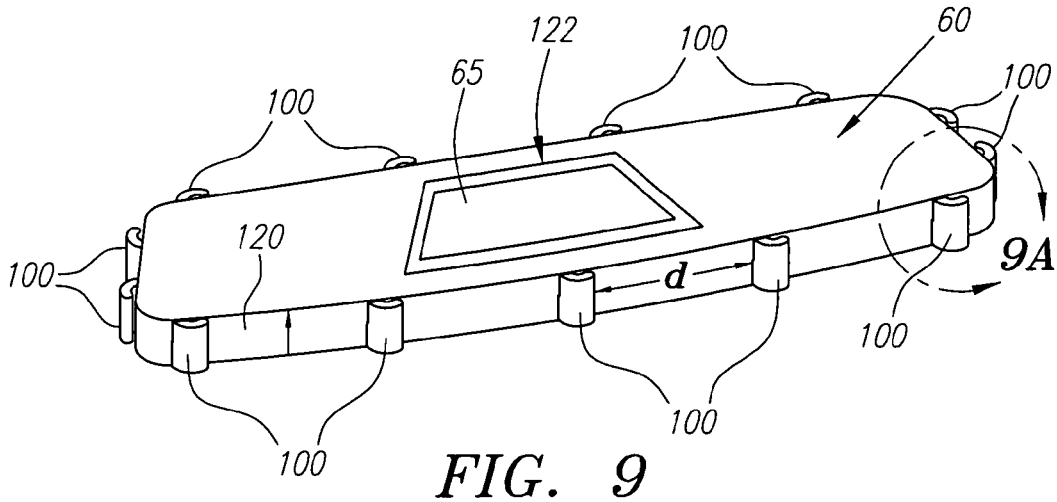
FIG. 9 is an isolated perspective view of one embodiment of an insert.
Figure 9A:
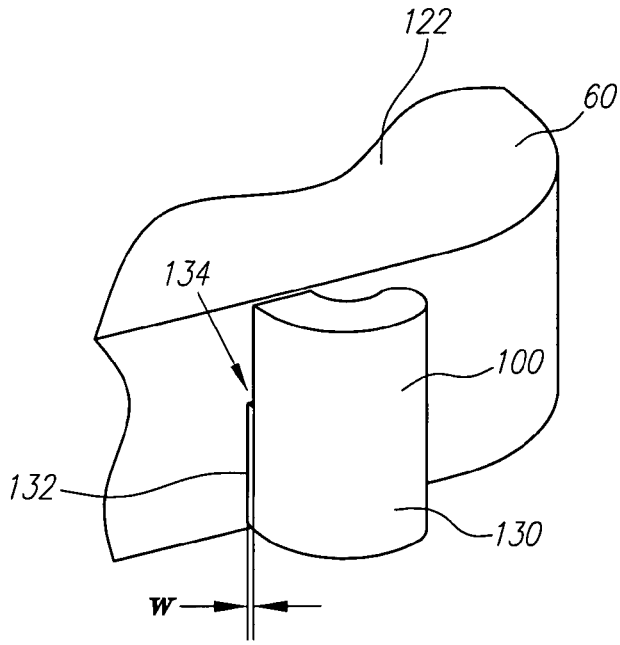
FIG. 9A is an enlarged view of circle A of FIG. 9.
Figure 10:
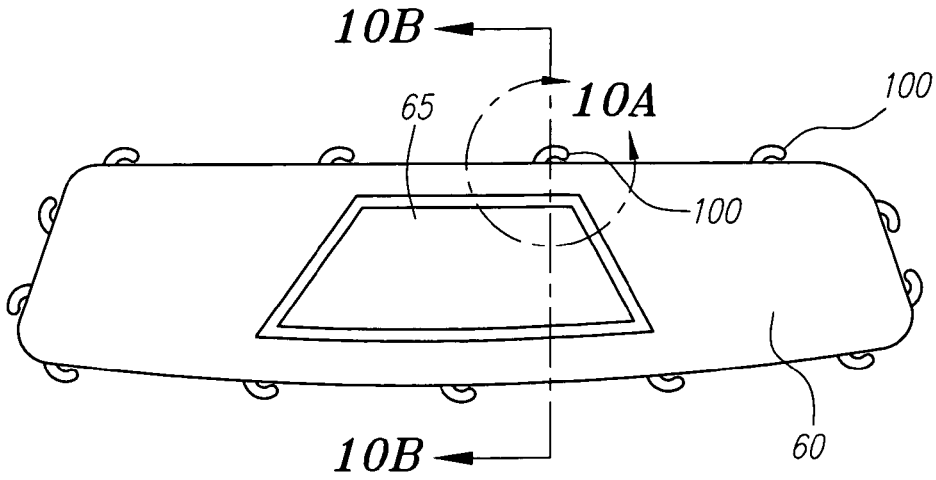
FIG. 10 is a front view of the insert of FIG. 9.
Figure 10A:
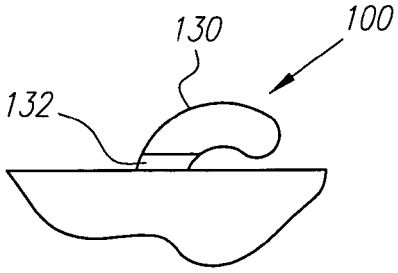
FIG. 10A is an enlarged view of circle A of FIG. 10.
Figure 10B:
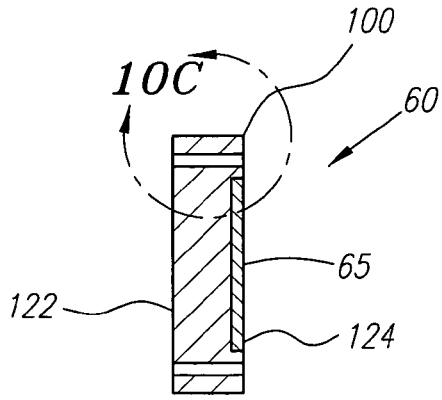
FIG. 10B is a cross-sectional view of the insert of FIG. 10 along lines B—B.
Figure 10C:
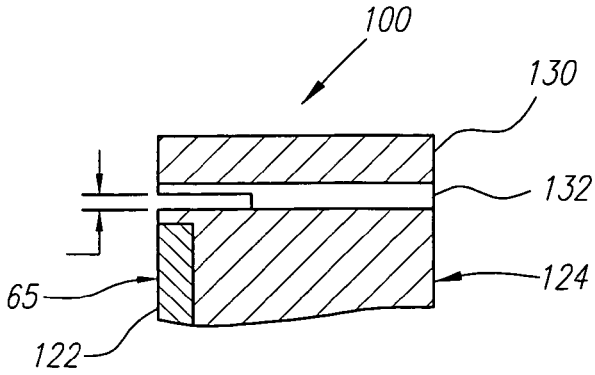
FIG. 10C is an enlarged view of circle C of FIG. 10B.

FIGS. 9–10C illustrate isolated views of one embodiment of the insert 60 of the present invention. The insert 60 has a plurality of tabs 100 spaced substantially equidistant apart. In a preferred embodiment, the distance "d" is 0.41 inches. However, those skilled in the pertinent art will recognize that the value of d may be adjusted for various embodiments. The plurality of tabs 100 lie on a perimeter 120 of the insert 60. The perimeter defines the thickness of the insert 60. A most preferred thickness is 0.198 inches, however the thickness may preferably range from 0.125 to 0.50 inches. The insert 60 has an interior surface 124 and an exterior surface 122. The interior surface 124 faces the recess face wall 80 while the exterior surface 122 forms a portion of the face 56 of the club head 52.

In a preferred embodiment, each of the plurality of tabs 100 is composed of a curved portion 130 and a straight portion 132. The straight portion 132 projects from the perimeter 120 and becomes the curved portion 130. The curved portion 132 engages with the recess edge wall 82 of the recess 58 of the club head 52. An undercut 134 is formed between the curved portion 130 and the perimeter 120 on the exterior surface 122 side of the insert 60. The undercut 134 is cut from the straight portion 132 thereby creating a straight portion 132 that does not extend along the entire width of the perimeter 120. Further, the curved portion 130 does not extend along the entire width of the perimeter 120, terminating just prior to the exterior surface 122. However, the curved portion 130 does extend further than the straight portion 132. The height "h" of the undercut 134 is preferably 0.01 inches, however it may range from 0.005 inches to 0.025 inches. Each of the plurality of tabs 100 is compressible for engagement of the insert 60 into the recess 58 of the club head 52. As described below, an adhesive is filled between the tabs 100 and into the undercuts 134 when the insert 60 is mounted in the recess 58 of the club head 52.

Figure 11:
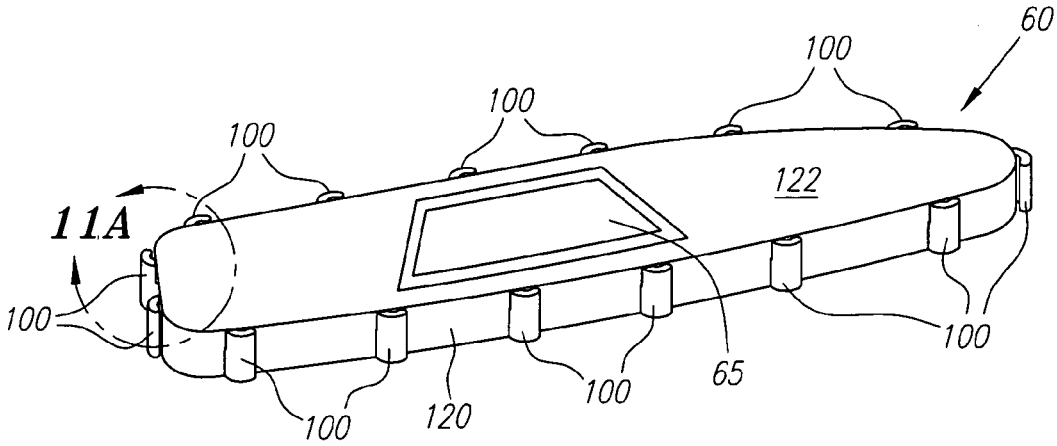
FIG. 11 is an isolated perspective view of an alternative embodiment of the insert.
Figure 11A:
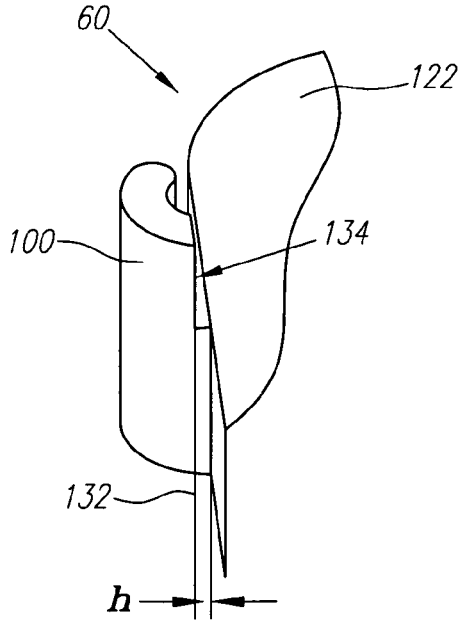
FIG. 11A is an enlarged view of circle A of FIG. 11.
Figure 12:
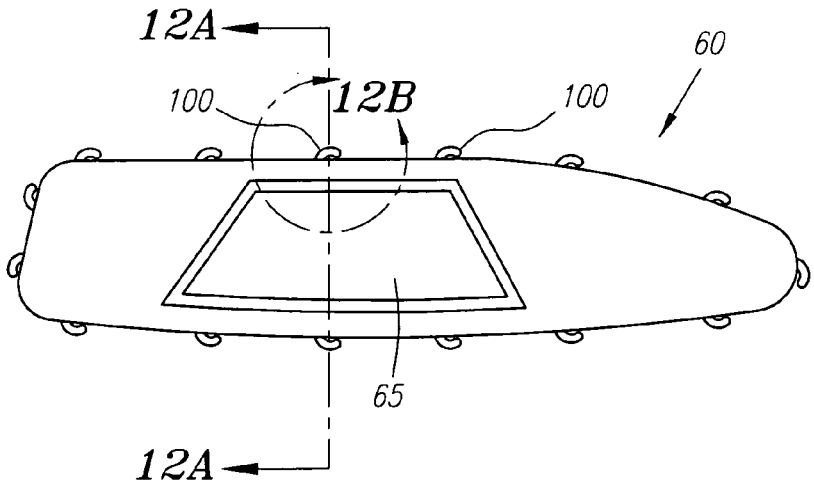
FIG. 12 is a front view of the insert of FIG. 11.
Figure 12B:
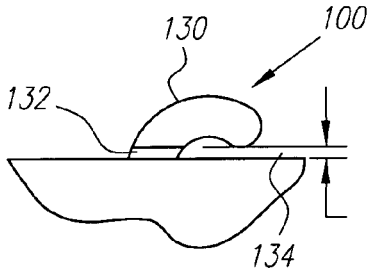
FIG. 12B is an enlarged view of circle B of FIG. 12.
Figure 12A:
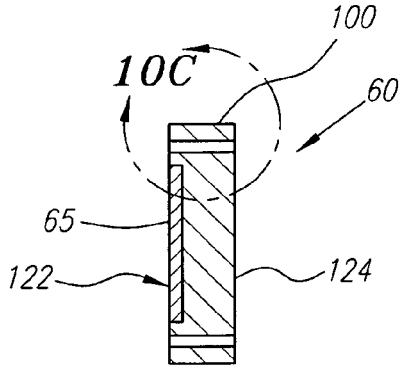
FIG. 12A is a cross-sectional view of the insert of FIG. 12 along lines A—A.
Figure 12C:
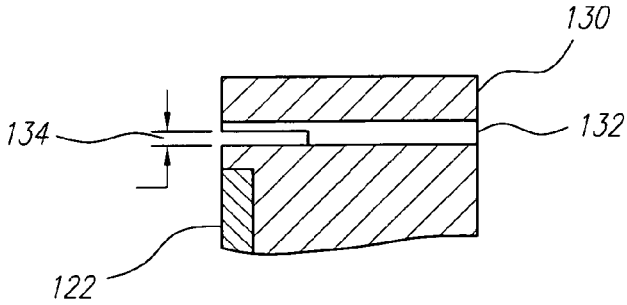
FIG. 12C is an enlarged view of circle C of FIG. 12A.

FIGS. 11–12C illustrate isolated views of a different embodiment of the insert of the present invention. The insert 60 of FIGS. 11–12C has different shape than the insert 60 of FIGS. 9–10C.

Figure 13:
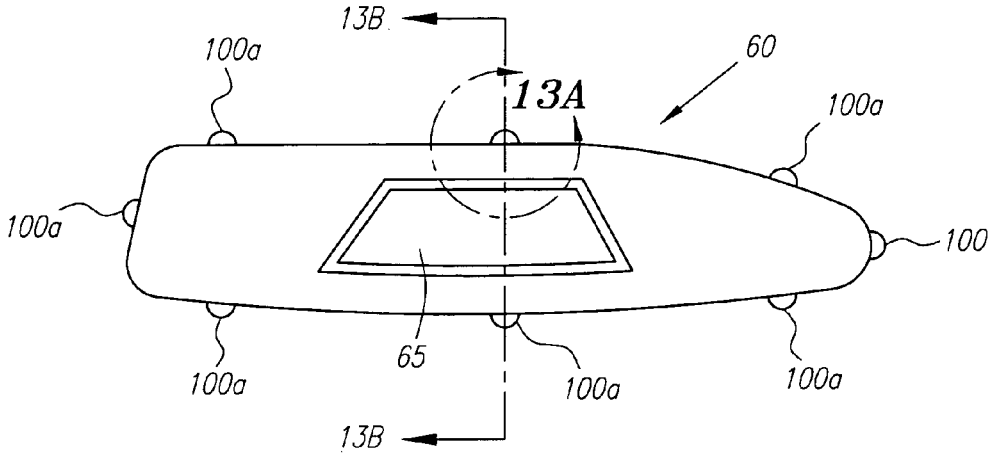
FIG. 13 is a front view of an alternative embodiment of the insert.
Figure 13A:
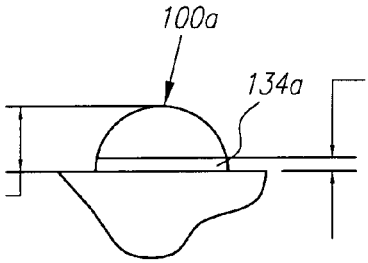
FIG. 13A is an enlarged view of circle A of FIG. 13.
Figure 13B:
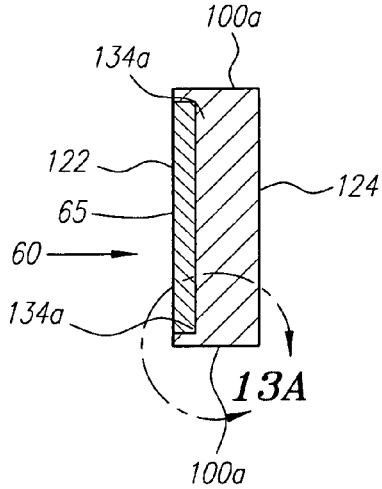
FIG. 13B is a cross-sectional view of the insert of FIG. 13 along lines B—B.
Figure 13C:
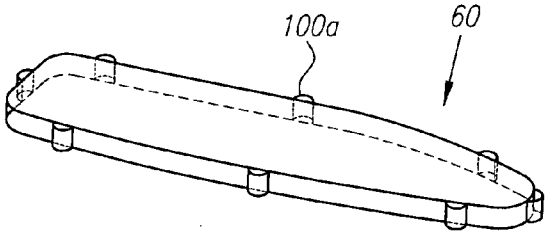
FIG. 13C is a perspective view of the insert of FIG. 13.

FIGS. 13–13C illustrate yet another embodiment of the insert 60 of the present invention. In this embodiment, each of the plurality of tabs 100*a* has a hemispherical shape with an undercut 134*a* on the exterior surface 122 side of the insert 60.

Figure 14:
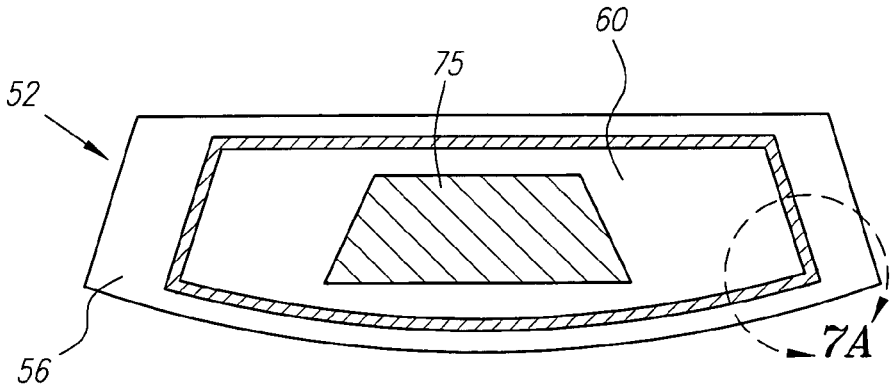
FIG. 14 is an isolated front view of an insert disposed within a recess of the face of a golf club head of the present invention.
Figure 14A:
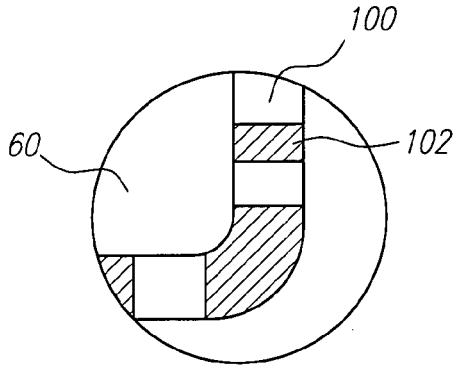
FIG. 14A is an enlarged view of the circle A of FIG. 14.
Figure 14B:
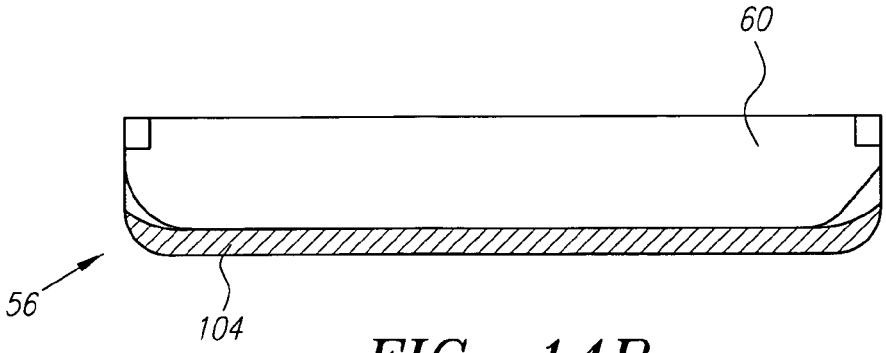
FIG. 14B is an isolated view of the insert within the recess of the club head, and bonded to the recess wall by an epoxy.
Figure 15:
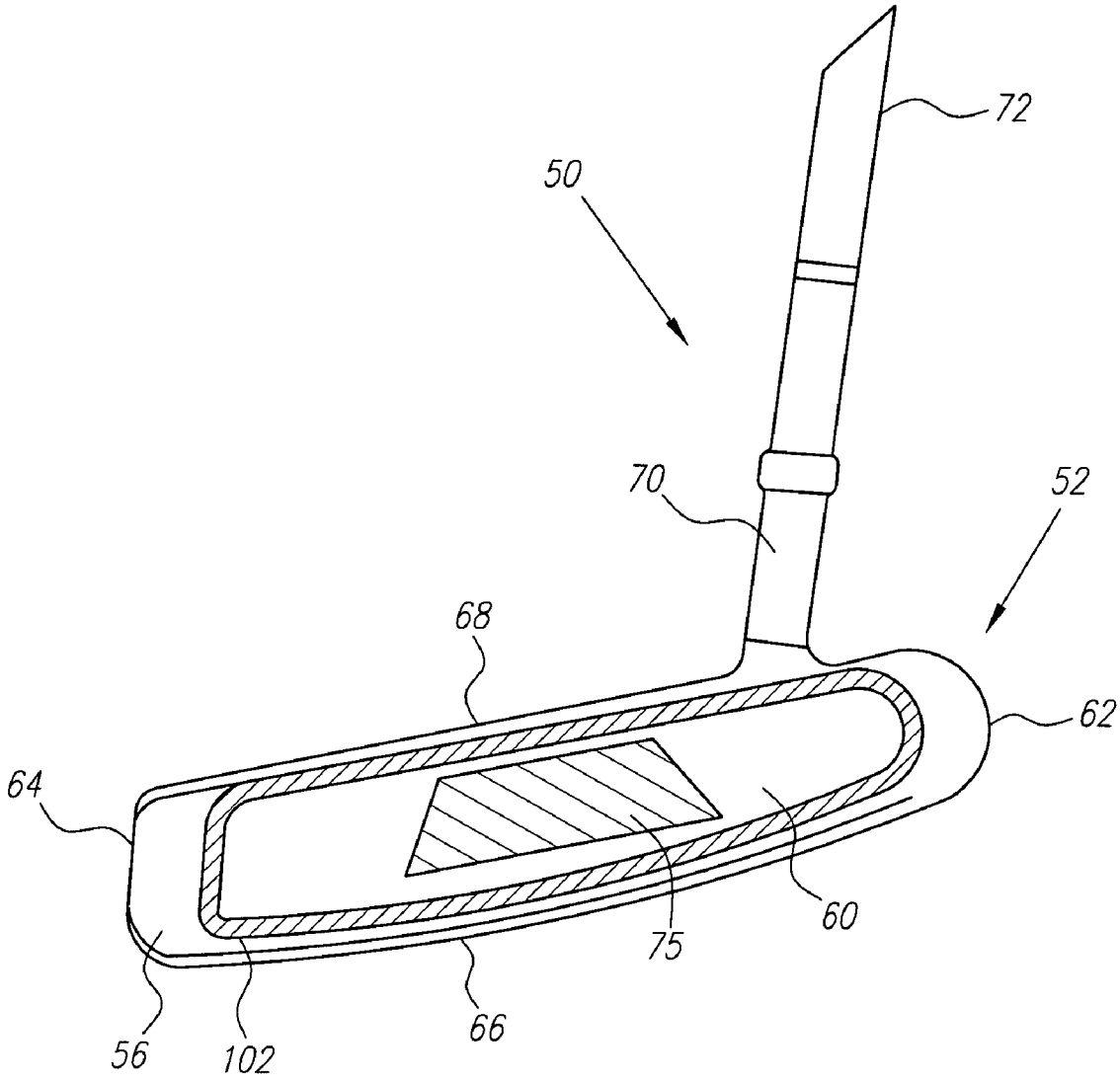
FIG. 15 is a front view of a putter of the present invention.
Figure 16:
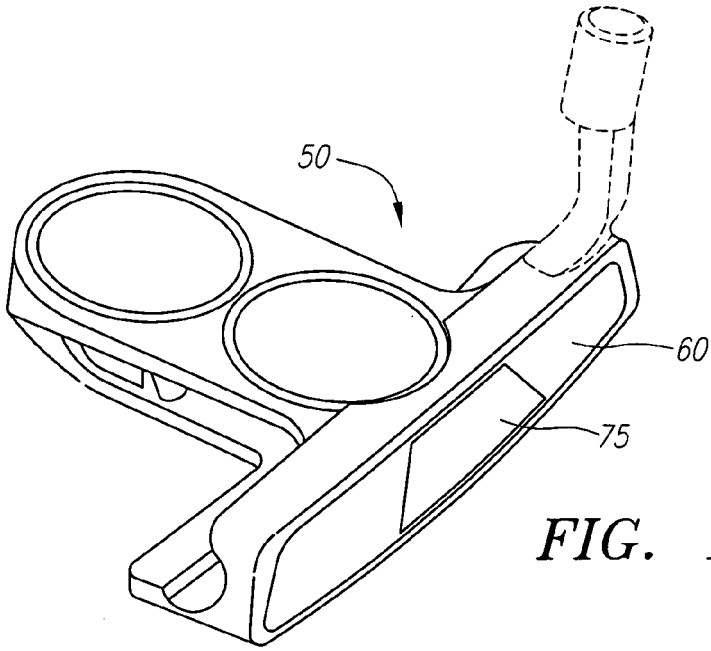
FIG. 16 is a top perspective another embodiment of the golf club head of the present invention with an insert in the recess of the club head body.
Figure 17:
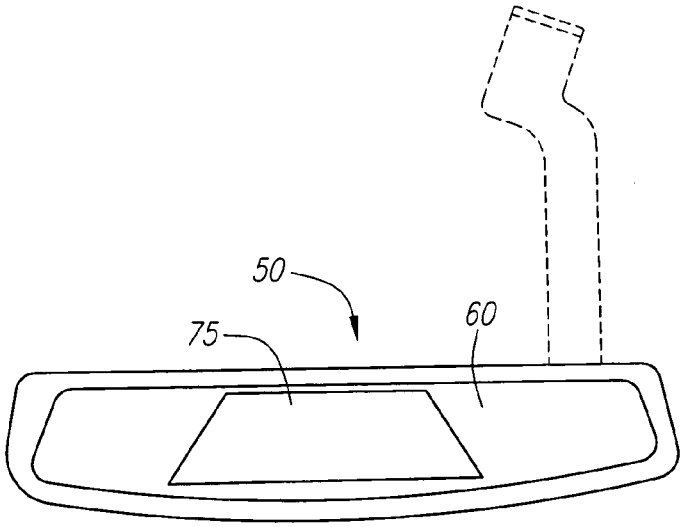
FIG. 17 is a front view of the golf club head of FIG. 16.
Figure 18:
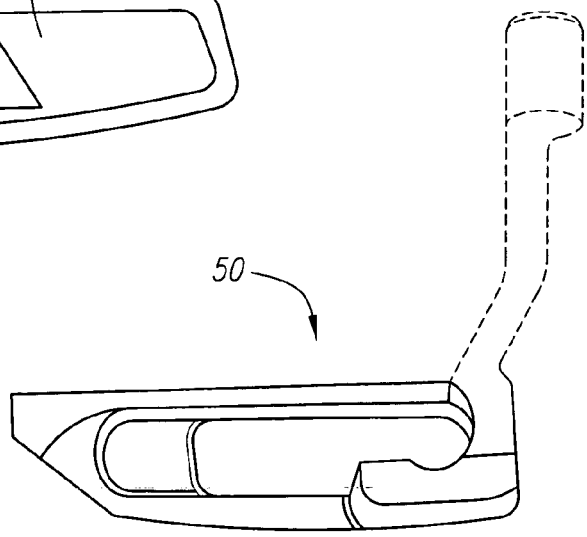
FIG. 18 is a side view of the golf club head of FIG. 16.
Figure 19:
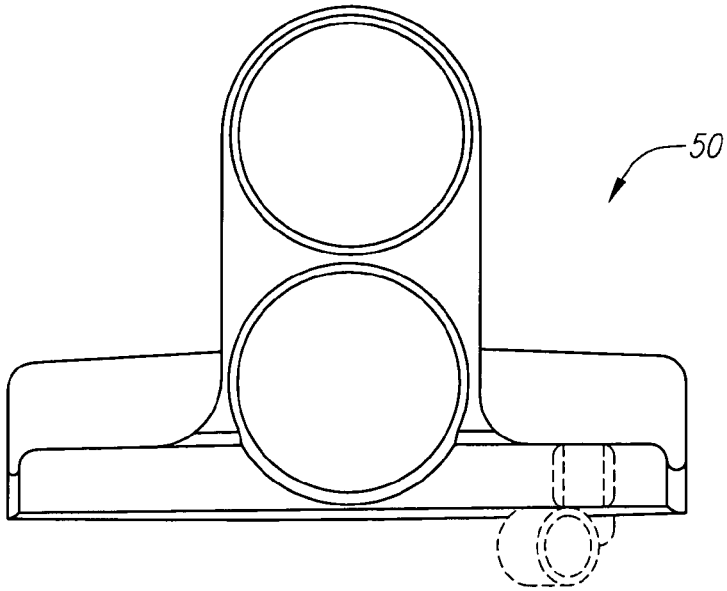
FIG. 19 is a top view of the golf club head of FIG. 16.
Figure 20:
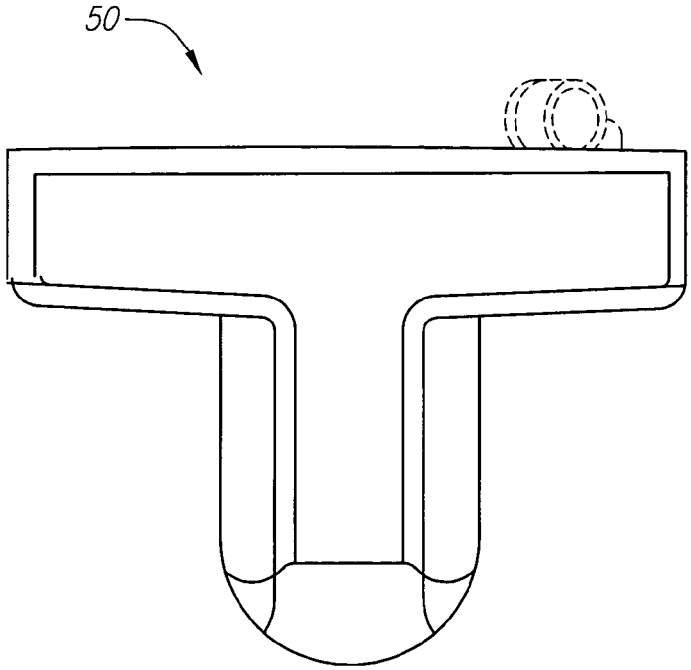
FIG. 20 is a bottom view of the golf club head of FIG. 16.

FIGS. 14–14B illustrate the attachment of the polymer insert 60 to the club head 54. The plurality of tabs 100 hold the insert in place, allowing it to "float" while the adhesive cures. The plurality of tabs 100 allow for precise depth placement of the insert within the recess. Such precision is not available in the prior art. Further, the ability of the insert 60 to "float" due to the plurality of tabs 100 also eliminates a tooling step in the manufacture of the club head of the present invention. As shown in FIGS. 14–14B, the polymer insert 60 is held within the recess 58 by the tabs 100 on the perimeter of the insert 100, an adhesive 102 applied into the spacings between the tabs 100, and an adhesive 104 applied to the recess frontal wall 80 and/or the interior surface 124 of the insert 60. In a preferred embodiment illustrated in FIG. 15, the adhesive 102 is applied along the entire perimeter 120, not shown, of the insert 60 thereby covering each of the plurality of tabs 100. A preferred adhesive is DP460 epoxy adhesive from 3M of Minneapolis, Minn. Other possible epoxies are JET WELD® urethane epoxy, and DP270, both available from 3M. Other adhesives may be utilized in practicing the present invention, however, the thermal coefficient of the adhesive should be applicable to manufacturing, distributing and playing temperatures of club heads.

FIGS. 16–20 illustrate an extended mallet type putter-type golf club head 20 with an alignment system such as disclosed in U.S. Pat. No. 6,471,600, issued on Oct. 22, 2002, which relevant parts are hereby incorporated by reference.

Tables One, Two and Three illustrate the ultraviolet light stability of the polymer insert of the present invention. Tables One, Two and Three compare the polymer of the present invention and other like polymer materials. E1 and E2 are the polymer inserts of the present invention. CE1 and CE2 are Hytrel materials. CE3 and CE4 are Estane materials. CE5 and CE6 are Hytrel materials. Table One illustrates the results prior to exposure. Table Two illustrates the results after 48 hours of exposure. Table Three illustrates the differences. DE is the combined differences.

TABLE ONE

| Example | L | a* | b* |
|---|---|---|---|
| E1 | 95.83 | −7.5 | 16.32 |
| E2 | 95.6 | −7.38 | 16.33 |
| CE1 | 95.9 | −6.87 | 19.64 |
| CE2 | 94.24 | −6.6 | 21.25 |
| CE3 | 94.5 | −7.52 | 15.22 |
| CE4 | 93.52 | −7.47 | 15.23 |
| CE5 | 94.45 | −7.17 | 16.35 |
| CE6 | 94.69 | −7.17 | 16.41 |

TABLE TWO

| Example | L | a* | b* |
|---|---|---|---|
| E1 | 95.81 | −7.42 | 16.41 |
| E2 | 95.6 | −7.46 | 16.25 |
| CE1 | 92.32 | −3.96 | 29.58 |

TABLE TWO-continued

| Example | L | a* | b* |
|---|---|---|---|
| CE2 | 91.6 | −3.74 | 29.66 |
| CE3 | 92.85 | −7.11 | 20.83 |
| CE4 | 90.81 | −6.55 | 24.31 |
| CE5 | 93.82 | −7.17 | 18.19 |
| CE6 | 93.84 | −7.18 | 18.17 |

TABLE THREE

| Example | L | a* | b* | DE |
|---|---|---|---|---|
| E1 | −0.02 | 0.08 | 0.09 | 0.12 |
| E2 | 0.00 | −0.08 | −0.08 | 0.11 |
| CE1 | −3.58 | 2.91 | 9.94 | 10.96 |
| CE2 | −2.64 | 2.86 | 8.41 | 9.27 |
| CE3 | −1.65 | 0.41 | 5.61 | 5.86 |
| CE4 | −2.71 | 0.92 | 9.08 | 9.52 |
| CE5 | −0.63 | 0.00 | 1.84 | 1.94 |
| CE6 | −0.85 | −0.01 | 1.76 | 1.95 |

The inserts were measured to determine the yellowing of the material after exposure to ultraviolet to simulate exposure to sunlight. The color of the inserts was determined using a HUNTER COLORIMETER model ULTRA SCAN XE and measuring the color on a L.a.b. scale. On the "L" scale, a measurement of 100 corresponds to complete white while a measurement of 0 corresponds to complete black. On the "a" scale, a negative number corresponds to a green color while a positive number corresponds to a red color. On the "b" scale, a negative number corresponds to a blue color while a positive number corresponds to a yellow color. Thus, the more positive the b measurement, the more yellow the insert.

As shown in Table Three, the insert of the present invention has almost complete ultraviolet light stability while inserts of the comparative examples vary greatly after 48 hours of exposure to ultraviolet light.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a club head body having a front face with a recess therein;

an insert disposed within the recess, the insert comprising a body with an exterior surface, an interior surface and a perimeter defining the thickness of the body, the exterior surface of the insert having an indented portion, the insert composed of a thermoplastic polyurethane material formed from a polytetramethylene ether glycol terminated hexamethylene diisocyanate prepolymer and a 1,4 butane diol, wherein the insert has a Shore D hardness ranging from 50 to 65, and the insert has a thickness ranging from 0.125 inch to 0.500 inch;

a face plate attached to the indented portion of the exterior surface of the insert, the face plate composed of a material having a density greater than the density of the polymer material, the face plate covering less than 90% of the exterior surface of the insert.

2. The golf club head according to claim 1 wherein each of the plurality of tabs is disposed a predetermined distance apart from each other and the golf club head further comprises an epoxy disposed between each of the plurality of tabs.

3. The golf club head according to claim 1 further comprising means for attaching the insert within the recess of the body.

4. The golf club head according to claim 3 wherein the attachment means is an epoxy adhesive applied to the interior surface of the insert.

5. The golf club head according to claim 1 wherein each of the plurality of tabs is compressible, and each of the plurality of tabs has a straight portion and a curved portion, the straight portion disposed between the curved portion and the perimeter, and the curved portion extending further than the straight portion to define an undercut between the curved portion and the perimeter.

6. The golf club head according to claim 1 wherein the insert has a change in ultraviolet light stability of less than 0.2% after an exposure time of 48 hours.

7. The golf club head according to claim 1 wherein each of the plurality of tabs is compressible, and each of the plurality of tabs is a substantially hemispherical body projecting from the perimeter and spaced a predetermined distance apart from each other.

8. The golf club head according to claim 1 wherein the face plate is composed of a metal selected from the group consisting of steel alloys, steel, titanium, titanium alloys, amorphous metals, aluminum, aluminum alloys, magnesium, magnesium alloys and bonze.

9. The golf club head according to claim 1 wherein the face plate is composed of a polymer material selected from the group consisting of polycarbonates, polyamides, polyesters, and ABS materials.

10. A putter club head comprising:

a club head body comprising a front face, a toe to one side of the front face and a heel to the other side of the front face, and a sole, the front face having a recess therein, the recess defined by a frontal recess wall and an edge wall substantially perpendicular to the frontal recess wall, the edge wall defining the depth and area of the recess;

an insert disposed within the recess, the insert comprising a body with an exterior surface, an interior surface and a perimeter defining the thickness of the body, the perimeter having a plurality of integral tabs extending therefrom that engage the edge wall of the club head body, each of the plurality of integral tabs spaced a predetermined distance from each other thereby defining openings between the integral tabs, the exterior surface of the insert having an indented portion, the insert composed of a thermoplastic polyurethane material formed from a polytetramethylene ether glycol terminated hexamethylene diisocyanate prepolymer having a NCO group content of 8.0% to 12.0%, and a 1,4 butane diol, wherein the insert has a Shore D hardness ranging from 50 to 65; and a face plate attached to the indented portion of the exterior surface of the insert, the face plate composed of a stainless steel alloy, the face plate covering less than 90% of the exterior surface of the insert.

11. The putter-type golf club head according to claim 10 wherein the insert has a heat deflection less than 1% after loading of fourteen pounds per square inch at a temperature of 200° F. for two hours.

12. A putter club head comprising:

a club head body comprising a front face, a toe to one side of the front face and a heel to the other side of the front face, and a sole, the front face having a recess therein, the recess defined by a frontal recess wall and an edge wall substantially perpendicular to the frontal recess wall, the edge wall defining the depth and area of the recess;

an insert disposed within the recess, the insert comprising a body with an exterior surface, an interior surface and a perimeter defining the thickness of the body, the perimeter having a plurality of integral tabs extending therefrom that engage the edge wall of the club head body, each of the plurality of integral tabs spaced a predetermined distance from each other thereby defining openings between the integral tabs, the exterior surface of the insert having an indented portion, the insert composed of a thermoplastic polyurethane material formed from a polytetramethylene ether glycol terminated hexamethylene diisocyanate prepolymer having a NCO group content of 8.0% to 12.0%, and a 1,4 butane diol, wherein the insert has a Shore D hardness ranging from 50 to 65, and wherein the insert has a change in ultraviolet light stability of less than 0.2% after an exposure time of 48 hours and a heat deflection less than 1% after loading of 14 pounds per square inch at a temperature of 200° F. for two hours; and a face plate attached to the indented portion of the exterior surface of the insert, the face plate composed of a stainless steel alloy, the face plate covering less than 90% of the exterior surface of the insert.

13. A putter-type club head comprising:

a body having a face portion, a crown portion, a sole portion and an aft-mass portion, wherein the face portion, the crown portion, the sole portion and the aft-mass portion define a central aperture through the body having a heel end opening and a toe end opening, wherein the crown portion extends rearward from the face portion to over the aft-mass portion, wherein the sole portion extends from face portion to the aft-mass portion, and wherein the central aperture separates the crown portion from the sole portion and the face portion from the aft-mass portion;

an insert disposed within a recess of the face portion, the insert composed of a thermoplastic polyurethane material formed from a polytetramethylene ether glycol terminated hexamethylene diisocyanate prepolymer having a NCO group content of 8.0% to 12.0%, and a 1,4 butane diol, wherein the insert has a Shore D hardness ranging from 50 to 65; and a face plate attached to an indented portion of an exterior surface of the insert, the face plate composed of a material having a density greater than the density of the polymer material, the face plate covering less than 90% of the exterior surface of the insert.

14. The putter-type club head according to claim 13 wherein the insert has a change in ultraviolet light stability of less than 0.2% after an exposure time of 48 hours.

15. The putter-type golf club head according to claim 13 wherein the insert has a heat deflection less than 1% after loading of fourteen pounds per square inch at a temperature of 200° F. for two hours.

16. The putter-type golf club head according to claim 13 wherein the face plate is composed of a metal selected from the group consisting of steel alloys, steel, titanium, titanium alloys, amorphous metals, aluminum, aluminum alloys, magnesium, magnesium alloys and bonze.

17. The putter-type golf club head according to claim 13 wherein the body is composed of a metal selected from the group consisting of titanium, titanium alloys, aluminum alloys, aluminum, stainless steel, magnesium, magnesium alloys and bronze.

18. A putter-type club head comprising:

a face portion having a recess with a face insert disposed therein, the insert composed of a thermoplastic polyurethane material formed from a polytetramethylene ether glycol terminated hexamethylene diisocyanate prepolymer having a NCO group content of 8.0% to 12.0%, and a 1,4 butane diol, wherein the insert has a Shore D hardness ranging from 50 to 65;

a sole portion extending rearward from the face portion, the sole portion having an internal surface and an external surface, the internal surface of the sole having a visible heel section and a visible to section;

an aft mass portion rearward from the face portion a distance of between 2.5 inches to 4.5 inches;

a crown portion extending rearward from the face portion, the crown portion having a central elongated section extending over the aft mass portion and a forward section having a width from a heel end of the face portion to a toe end of the face portion from between 3.0 inches to 5.0 inches, the forward section having a width greater than a width of the central elongated portion; and an alignment means disposed on an external surface of the crown portion.

19. The putter-type club according to claim 18 further comprising a face plate attached to an indented portion of an exterior surface of the insert, the face plate composed of a material having a density greater than the density of the polymer material, the face plate covering less than 90% of the exterior surface of the insert.

20. The putter-type club head according to claim 18 wherein the insert has a change in ultraviolet light stability of less than 0.2% after an exposure time of 48 hours.

21. The putter-type golf club head according to claim 18 wherein the insert has a heat deflection less than 1% after loading of fourteen pounds per square inch at a temperature of 200° F. for two hours.

22. The putter-type golf club head according to claim 19 wherein the face plate is composed of a metal selected from the group consisting of steel alloys, steel, titanium, titanium alloys, amorphous metals, aluminum, aluminum alloys, magnesium, magnesium alloys and bonze.

23. The putter-type golf club head according to claim 18 wherein the body is composed of a metal selected from the group consisting of titanium, titanium alloys, aluminum alloys, aluminum, stainless steel, magnesium, magnesium alloys and bronze.

24. A putter-type club head comprising:

a face portion having a recess with an insert, the insert composed of a thermoplastic polyurethane material formed from a polytetramethylene ether glycol terminated hexamethylene diisocyanate prepolymer having a NCO group content of 8.0% to 12.0%, and a 1, 4 butane diol, wherein the insert has a Shore D hardness ranging from 50 to 65;

a crown portion having a front section and a central elongated section extending rearward from the front section, the front section having a width from a heel end of the putter-type club head to a toe end of the putter-type club head ranging from 3.0 inches to 5.0 inches, the central elongated section having a width ranging from 1.0 inch to 3.0 inches, the front section having a width greater than a width of the central elongated section;

a sole portion extending rearward from the face portion;

an aft mass portion disposed at a rearward end of the sole portion; and an alignment means disposed on an external surface of the crown portion;

wherein the putter-type club head has length from the face portion to a rearward most end of the aft mass portion ranging from 2.5 inches to 4.5 inches.

25. The putter-type club according to claim 24 further comprising a face plate attached to an indented portion of an exterior surface of the insert, the face plate composed of a material having a density greater than the density of the polymer material, the face plate covering less than 90% of the exterior surface of the insert.

26. The putter-type club head according to claim 24 wherein the insert has a change in ultraviolet light stability of less than 0.2% after an exposure time of 48 hours.

27. The putter-type golf club head according to claim 24 wherein the insert has a heat deflection less than 1% after loading of fourteen pounds per square inch at a temperature of 200° F. for two hours.

28. The putter-type golf club head according to claim 25 wherein the face plate is composed of a metal selected from the group consisting of steel alloys, steel, titanium, titanium alloys, amorphous metals, aluminum, aluminum alloys, magnesium, magnesium alloys and bonze.

29. The putter-type golf club head according to claim 24 wherein the body is composed of a metal selected from the group consisting of titanium, titanium alloys, aluminum alloys, aluminum, stainless steel, magnesium, magnesium alloys and bronze.

30. A putter-type club head comprising:

a face portion having an external surface and an internal surface;

a sole portion extending rearward from the face portion and having a semi-circular shape;

an aft mass portion disposed at a rearward end of the sole portion, the aft mass portion having 10 to 30 volume percent of the putter-type club head and from 25 to 75 weight percent of the putter-type club head;

a crown portion extending rearward from the face portion, the crown portion having a central elongated section extending over the aft mass portion and a forward section having a width from a heel end of the face portion to a toe end of the face portion, the forward section having a width greater than a width of the central elongated portion; and an alignment means disposed on an external surface of the crown portion;

wherein the face portion, the crown portion, the sole portion and the aft-mass portion define a central aperture through the body having a heel end opening and a toe end opening; and a face insert disposed within a recess of the face portion, the face insert composed of a thermoplastic polyurethane material formed from a polytetramethylene ether glycol terminated hexamethylene diisocyanate prepolymer having a NCO group content of 8.0% to 12.0%, and a 1, 4 butane diol, wherein the face insert has a Shore D hardness ranging from 50 to 65.

31. The putter-type club according to claim 30 further comprising a face plate attached to an indented portion of an exterior surface of the insert, the face plate composed of a material having a density greater than the density of the polymer material, the face plate covering less than 90% of the exterior surface of the insert.

32. The putter-type club head according to claim 30 wherein the insert has a change in ultraviolet light stability of less than 0.2% after an exposure time of 48 hours.

33. The putter-type golf club head according to claim 30 wherein the insert has a heat deflection less than 1% after loading of fourteen pounds per square inch at a temperature of 200° F. for two hours.

34. The putter-type golf club head according to claim 31 wherein the face plate is composed of a metal selected from the group consisting of steel alloys, steel, titanium, titanium alloys, amorphous metals, aluminum, aluminum alloys, magnesium, magnesium alloys and bonze.

35. The putter-type golf club head according to claim 30 wherein the body is composed of a metal selected from the group consisting of titanium, titanium alloys, aluminum alloys, aluminum, stainless steel, magnesium, magnesium alloys and bronze.

36. The putter-type club according to claim 35 further comprising a face plate attached to an indented portion of an exterior surface of the insert, the face plate composed of a material having a density greater than the density of the polymer material, the face plate covering less than 90% of the exterior surface of the insert.

37. The putter-type club head according to claim 35 wherein the insert has a change in ultraviolet light stability of less than 0.2% after an exposure time of 48 hours.

38. The putter-type golf club head according to claim 35 wherein the insert has a heat deflection less than 1% after loading of fourteen pounds per square inch at a temperature of 200° F. for two hours.

39. The putter-type golf club head according to claim 35 wherein the body is composed of a metal selected from the group consisting of titanium, titanium alloys, aluminum alloys, aluminum, stainless steel, magnesium, magnesium alloys and bronze.

40. A putter-type club head comprising:

a body having a face portion, a crown portion, a sole portion and an aft-mass portion, wherein the face portion, the crown portion, the sole portion and the aft-mass portion define a central aperture through the body having a heel end opening and a toe end opening, wherein the crown portion extends rearward from the face portion to over the aft-mass portion, wherein the sole portion extends from face portion to the aft-mass portion, wherein the central aperture separates the crown portion from the sole portion and the face portion from the aft-mass portion, and wherein the face portion has an external surface with a recess therein;

a plurality of recesses on an external surface of the crown portion, each of the plurality of recesses having a circular shape with a diameter ranging from 1.62 inches to 1.70 inches;

a plurality of circular inserts, each of the plurality of circular inserts disposed within a corresponding recess of the plurality of recesses; and a face insert disposed within a recess of the face portion, the face insert composed of a thermoplastic polyurethane material formed from a polytetramethylene ether glycol terminated hexamethylene diisocyanate prepolymer having a NCO group content of 8.0% to 12.0%, and a 1,4 butane diol, wherein the face insert has a Shore D hardness ranging from 50 to 65.

41. The putter-type golf club head according to claim 40 wherein the face plate is composed of a metal selected from the group consisting of steel alloys, steel, titanium, titanium alloys, amorphous metals, aluminum, aluminum alloys, magnesium, magnesium alloys and bonze.

42. A golf club head comprising:

a club head body having a front face with a recess therein, the body composed of a stainless steel material;

an insert disposed within the recess, the insert comprising a body with an exterior surface, an interior surface and a perimeter defining the thickness of the body, the exterior surface of the insert having an indented portion, the insert composed of a thermoplastic polyurethane material formed from a hexamethylene diisocyanate based prepolymer, wherein the insert has a Shore D hardness ranging from 50 to 65, and the insert has a thickness ranging from 0.125 inch to 0.500 inch;

a face plate attached to the indented portion of the exterior surface of the insert, the face plate composed of a material having a density greater than the density of the polymer material, the face plate covering less than 90% of the exterior surface of the insert.

* * * * *